US010914494B2

(12) United States Patent
McKie

(10) Patent No.: US 10,914,494 B2
(45) Date of Patent: Feb. 9, 2021

(54) SEGMENTED CAVITATION BOILER

(71) Applicant: NewCo H20 LLC, Greensboro, NC (US)

(72) Inventor: Justin McKie, Wichita Falls, TX (US)

(73) Assignee: NewCo H20 LLC, Greensboro, NC (US)

( * ) Notice: Subject to any disclaimer, the term of this patent is extended or adjusted under 35 U.S.C. 154(b) by 275 days.

(21) Appl. No.: 15/906,599

(22) Filed: Feb. 27, 2018

(65) Prior Publication Data

US 2019/0264954 A1 Aug. 29, 2019

(51) Int. Cl.

| | |
|---|---|
| ***F24V 40/00*** | (2018.01) |
| ***F22B 3/06*** | (2006.01) |
| ***F04D 1/06*** | (2006.01) |

(52) U.S. Cl.

CPC ..... *F24V 40/00* (2018.05); *F04D 1/06* (2013.01); *F22B 3/06* (2013.01)

(58) Field of Classification Search

CPC .. F24V 40/00; F24V 40/10; F22B 3/06; F22B 3/08; F22B 3/005; F04D 1/06; F04D 1/08; F04D 1/0011; F04D 29/648; F04D 29/541; F04D 29/522; F04D 29/181; F04D 29/183; B01F 11/0077

See application file for complete search history.

(56) References Cited

U.S. PATENT DOCUMENTS

| | | | | |
|---|---|---|---|---|
| 888,192 | A * | 5/1908 | Rees | F04D 1/06 415/100 |
| 4,325,354 | A * | 4/1982 | Fuchs | F24V 40/00 126/247 |
| 7,767,159 | B2 * | 8/2010 | Glotov | B01F 13/1016 422/127 |
| 2017/0241218 | A1 | 8/2017 | McKie | |
| 2017/0306982 | A1 | 10/2017 | McKie | |

* cited by examiner

*Primary Examiner* — Steven S Anderson, II
(74) *Attorney, Agent, or Firm* — Fish & Richardson P.C.

(57) ABSTRACT

A cavitation boiler segment includes a rotor to be coupled with a rotating inner drum and a stator surrounding the rotor segment. The rotor and the stator each include drums with two banks of annular apertures, which overlap to define two cavitation regions. The rotor includes a web bifurcating the rotor between the apertures into an upstream side and a downstream side, each forming a separate fluid passage between a face of the rotor and a bank of apertures. The stator includes a casing enclosing the stator apertures in a fluid passageway. In operation, fluid flows into a first side of the rotor, across a first cavitation region and into the stator, then back across the second cavitation region and into the second side of the rotor where the fluid may flow into a first side of an adjacent segment.

22 Claims, 18 Drawing Sheets

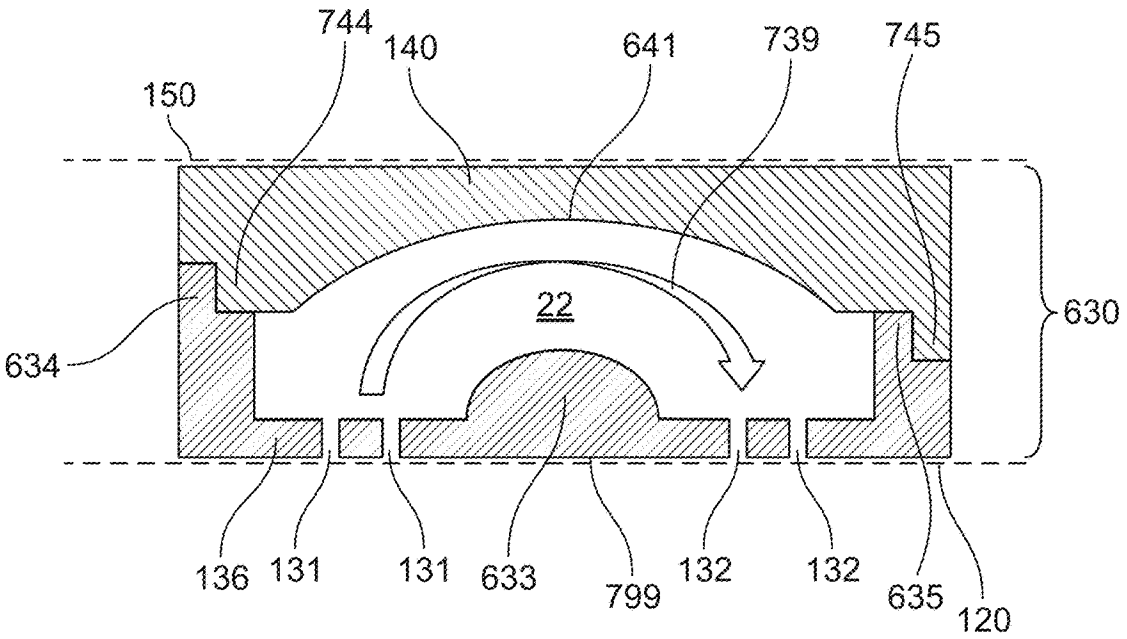
FIG. 7C
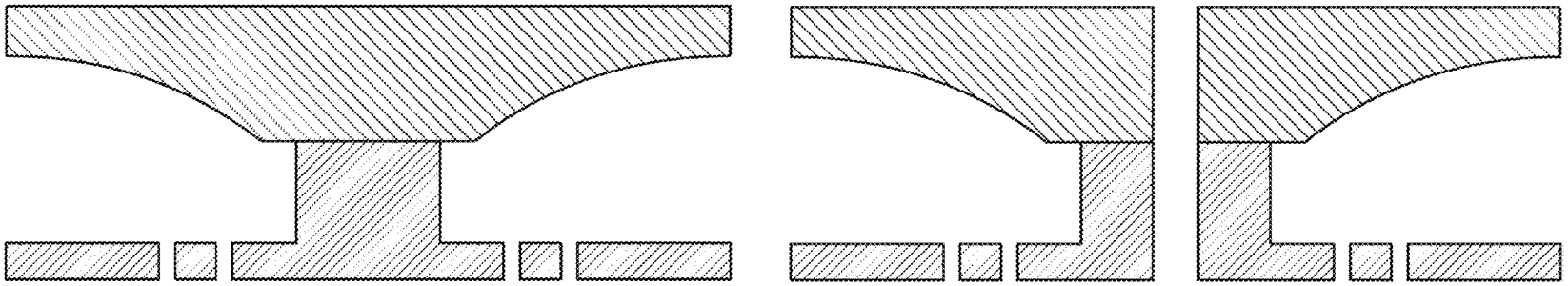
FIG. 7D
FIG. 7E

SEGMENTED CAVITATION BOILER

FIELD

The present disclosure concerns fluid pumps and cavitation boiler.

BACKGROUND

Typical rotational fluid devices, such as pumping, mixing, and cavitation devices, operate on fluids by mechanically rotating a rotor or impeller in a reaction chamber with a stator, while a flow of fluid passes from an inlet, across the rotor or impeller, and to an outlet. Typical fluid devices comprise a one-piece reaction chamber housing with an end-cap sealing the housing or a two-piece housing split laterally to enable longitudinal separation of from piece from the other. These conventional designs enable the fluid device to be constructed or serviced by removing an end of the reaction chamber housing to access the rotor or stator in a longitudinal direction.

SUMMARY

The concepts herein encompass using a fluid device having a reaction chamber constructed from segmented rotors and stators. The concepts herein can also relate to pumping devices, cavitation boiler machines, and mixers. The concepts herein further relates to fluid devices having a reaction chamber housing formed of multiple casings removeably coupled at longitudinal mating regions deposed along the length of the reaction chamber housing with respect to the axis of rotation. Embodiments disclosed herein provide an ability to convert a typical multi-stage pump into a cavitation boiler by replacing the pumping segments with a rotor assembly including individual rotor segments that spin inside of corresponding individual stator segments disposed in a stationary outer drum. One skilled in the art will appreciate a substantial reduction in maintenance complexity using the present design.

In an example, a cavitation boiler segment is configured to be disposed in a housing. The cavitation boiler segment includes a rotor segment configured to be secured around an inner drum of the housing, where the rotor segment includes: (i) a rotor drum having first and second annular banks of apertures through the rotor drum, the rotor drum defining an outer surface of the rotor segment, (ii) a hub configured to interface with the inner drum, and (iii) an annular web connecting the hub to the rotor drum between the first and second annular banks of apertures. The annular web includes an upstream surface defining a first fluid passageway between an upstream face of the rotor segment and the first bank of apertures, and a downstream surface defining a third fluid passageway between a downstream face of the rotor segment and the second bank of apertures. The cavitation boiler segment also includes a stator segment configured to be inserted into an outer drum of the housing, with the stator segment having a stator drum having third and fourth annular banks of apertures through the stator drum arranged to overlap the first and second banks of apertures through the rotor drum, the stator drum defining an inner surface of the stator segment, and a stator casing configured to interface with an outer drum of the housing, the stator casing enclosing the third and fourth annular banks of apertures in an interior chamber defining a second fluid passageway between the third and fourth annular banks of apertures. In addition, the first, second, and third fluid passageways together define a flowpath through the cavitation boiler segment.

In some instances, the outer surface of the rotor segment and the inner surface of the stator segment define a cavitation region therebetween. In some instances, the cavitation region includes a first cavitation region between the first and third banks of apertures, and a second cavitation region between the second and fourth banks of apertures, and wherein, when the rotor segment rotates with respect to the stator segment, the first cavitation region is configured to generate cavitation in a fluid flowing radially outward from to the first bank of apertures to the third bank of apertures, and the second cavitation region is configured to generate cavitation in the fluid flowing radially inward from the fourth bank of apertures to the second bank of apertures.

In some instances, the rotor drum extends from the web to an upstream drum lip defining an upstream segment of the rotor drum, and from the web to a downstream drum lip defining a downstream segment of the rotor drum, the upstream segment of the rotor drum having the first bank of apertures and the downstream segment of the rotor drum having the second bank of apertures.

In some instances, the rotor segment includes a first ring having the upstream segment of the rotor drum, a first annular web includes the upstream surface of the annular web, and an upstream segment of the hub. In addition, the rotor segment includes a second ring having the downstream segment of the rotor drum, a second annular web including the downstream surface of the annular web, and a downstream segment of the hub. Where the first and second rings are configured to be arranged adjacent to each other on the inner drum of the housing and, when adjacent, form the outer surface of the rotor segment.

In some instances, the first and second rings are integrally formed with the rotor segment.

In some instances, the first ring includes the first fluid passageway and the first ring is configured to receive an axial flow of a fluid and direct the fluid in a radially outward direction across the first plurality of apertures, and the second ring includes the third fluid passageway and the second ring is configured to receive a radially inward flow of the fluid second annular bank of apertures and direct the fluid in the axial direction.

In some instances, wherein the first ring include the upstream surface of the first ring is shaped to direct the axial fluid flow received by the first in a radially outward direction through the first bank of apertures, and the downstream surface of the second ring is shaped to direct the radially inward fluid flow received from the second bank of apertures in the axial direction.

In some instances, the upstream face of the first ring defines an inlet opening, and the downstream face of the second ring defines and outlet opening, and wherein the inlet and outlet opening are sized and dimensioned to define opposing halves of an annular chamber.

In some instances, the downstream and upstream faces of the rotor segment are each configured to interface with a corresponding face of a second rotor segment arranged adjacent to the rotor segment.

In some instances, the first and second fluid passageways are annular channels around the rotor segment.

In some instances, the first and second annular banks of apertures are arranged in parallel around the outer drum of the rotor segment, and the third and fourth annular banks of apertures are arranged in parallel around the inner drum of the stator segment.

In some instances, the stator casing includes an outer surface configured to secure the stator segment to the outer drum, and an inner surface having formed therein an annular channel defining at least a portion of the interior chamber of the stator segment.

In some instances, a gap between the outer surface of the rotor segment and the inner surface of the stator ring is between 0.05 and 0.002 inches along the entire axial length.

In some instances, the gap is between and 0.05 and 0.002 inches along the entire axial length.

In some instances, when the stator segment is arranged around the rotor segment, the first and third fluid passageways of the rotor segment are only in fluid connection with each other through the second fluid passageway of the stator segment, absent a gap between the outer surface of the rotor drum and the inner surface of the stator drum.

In some instances, the third fluid passageway of the stator is configured to direct a radially outward flow from the third bank of apertures into a radially inward flow toward the fourth bank of apertures.

Another example is a cavitation boiler chamber including a housing having a rotatable inner drum including first and second end caps configured to couple the inner drum to an input shaft, and a stationary outer drum disposed around the rotatable inner drum. The boiler chamber also includes a plurality of cavitation boiler segments, described above, disposed in the housing, the plurality of cavitation boiler segments being arranged in series such that a fluid passageway is defined through the plurality of cavitation boiler segments, wherein the flow path through each cavitation boiler segment defines a sequential portion of the continuous fluid passageway, and wherein each rotor assembly is arranged in the housing and secured to the rotatable inner drum, and each stator assembly is arranged in the housing and secured to the stationary out drum.

In some instances, the cavitation boiler chamber includes a pump segment disposed in the housing upstream of the plurality of cavitation boiler segments, the pump segment having an outlet in fluid communication with the upstream face of a first rotor segment of the plurality of cavitation boiler segments, the pump segment being configured to pump the fluid through the continuous fluid passageway of the plurality of cavitation boiler segments.

Yet another example of the present disclosure is a cavitation device having the cavitation boiler chamber described with, an inlet housing defining a fluid inlet into the boiler chamber housing, the fluid inlet in fluid communication with the fluid passageway of the cavitation boiler chamber, an outlet housing defining a fluid outlet from the cavitation boiler chamber, the fluid outlet in fluid communication with the fluid passageway, and an input shaft spanning between the inlet housing and the outlet housing and coupled to the rotatable inner drum of the housing of the cavitation boiler, the input shaft configured to be coupled to a motor.

Still yet another example of the present disclosure is a cavitation boiler segment configured to be disposed in a housing. The cavitation boiler segment includes a rotor segment configured to be secured around an inner drum of the housing, where the rotor segment includes a rotor drum defining an outer surface of the rotor segment and having a first and a second set of apertures through the outer drum, the rotor drum, and the rotor segment defining an upstream annular fluid passageway and a downstream annular fluid passageway adjacent and separate from the upstream annular fluid passageway, the upstream annular fluid passageway is configured to receive and axial flow of a fluid and direct the fluid in a radially outward direction across the first set of apertures of the rotor drum, and the downstream annular fluid passageway is configured to receive a radially inward flow of the fluid from the second set of apertures and direct the fluid in an axial direction. Where the rotor segment is configured to interface with a second rotor segment disposed adjacent to the rotor segment, such that the downstream annular fluid passageway of the rotor segment is in fluid communication with the upstream annular fluid passageway of the second rotor segment. The cavitation boiler segment also includes a stator segment configured to be inserted into an outer drum of the housing, where the stator segment includes a stator drum defining an inner surface of the stator segment and having a third and a fourth set of apertures through the stator drum located to overlap the first and second sets of apertures when the stator segment is disposed around the rotor segment, and a stator casing configured to interface with an outer drum of the housing, the stator casing enclosing the third and fourth sets of apertures in an interior chamber defining a stator fluid passageway between the third and fourth sets of apertures.

Yet another example is a method for generating cavitation with a cavitation boiler segment comprising a rotor segment disposed inside a stator segment. The method includes rotating the rotor segment inside the stator segment such that a first plurality of apertures of the rotor segment transits a first plurality of apertures of the stator segment and a second plurality of apertures of the rotor segment transits a second plurality of apertures of the stator segment. The first plurality of apertures of the rotor and stator segments define a first cavitation region therebetween, and the second pluralities of apertures of the rotor and stator segments define a second cavitation region therebetween. Continuing, the method includes accepting a flow of a fluid at an upstream side of the rotor segment and passing the fluid from the an upstream side of the rotor segment into a fluid passageway in the stator segment through the first cavitation region, whereby the rotation of the rotor segment generates cavitation in the fluid passing through the first cavitation region. Then passing the fluid passageway in the stator segment into a downstream side of the rotor segment through the second cavitation region, whereby the rotation of the rotor segment generates cavitation in the fluid passing through the second cavitation region.

Generally, one skilled in the art will appreciate that individual rotor and stator segments enables a cavitation reaction chamber housing to be constructed around an existing multi-stage pumping housing. Additionally, one skilled in the art will appreciate that the segmented cavitation boiler design described herein enables precise tolerances to be maintained in a cavitation region between each set of a rotor and stator segment set without similarly precise tolerances being maintained between adjacent rotor and stator segments. The tolerances discussed include stack up tolerances of a multi-stage pump type pump/cavitator. Because of each stage being completely separate and typically unable to be machined as a complete assembly, stack up tolerances become a larger issue as more and more sections are stacked. Aspects of the present disclosure alleviate those issues by enabling a stack up of the assembly to do a final machine step to ensure there is no stack up between stages. In addition, the segmented cavitation boiler design minimizes unwanted movement of fluid through each segment by focusing the work (e.g., cavitation) to locations farther from the central axis of rotation. The internal design of the rotor and stator segments also reduce the radial length of travel of a fluid and thereby reduce the overall length of the path of travel for fluid through the cavitation boiler.

Some, none or all of the aforementioned examples, and examples throughout the following descriptions, can be combined.

BRIEF DESCRIPTION OF DRAWINGS

FIGS. 7A-7C are cross-sectional diagrams of the stator segment.

FIGS. 7D and 7E are cross-sectional diagrams of an alternative stator segment.

DETAILED DESCRIPTION

One aspect of the present disclosure is a segmented cavitation boiler constructed by removing the pump segments of a multi-stage centrifugal pump, which use a standard impeller designed to move water, and replacing the internals with a new "segmented drum" assembly that include a plurality of individual rotor and stator segments. In some instances, and in contrast to prior art cavitation generators, the segmented cavitation boiler disclosed herein does not increase the pressure of the fluid flowing through cavitation boiler segments.

Figure 1A:
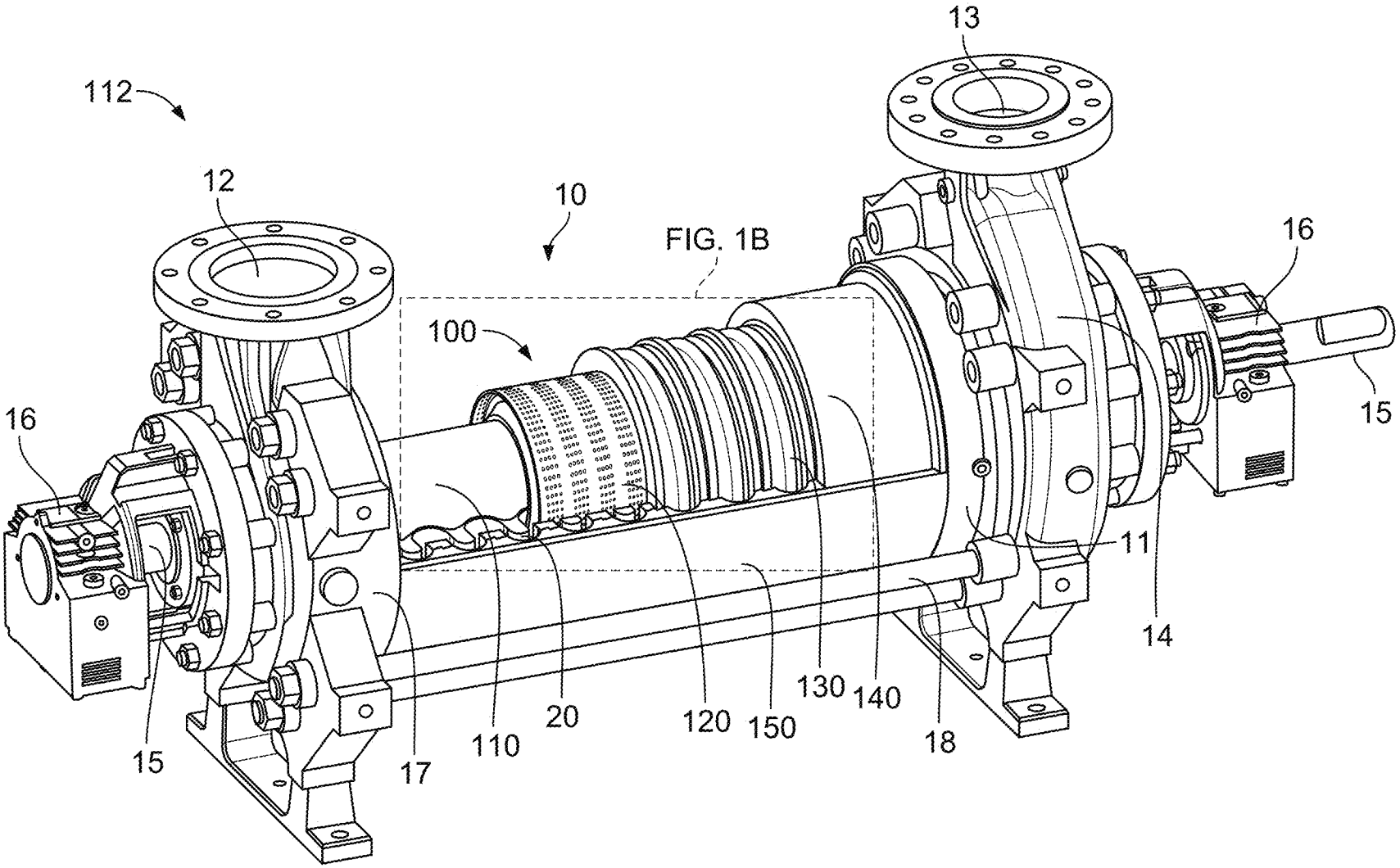
FIG. 1A is a cut-away view of a cavitation boiler installed in a multi-stage pump assembly.
Figure 1B:
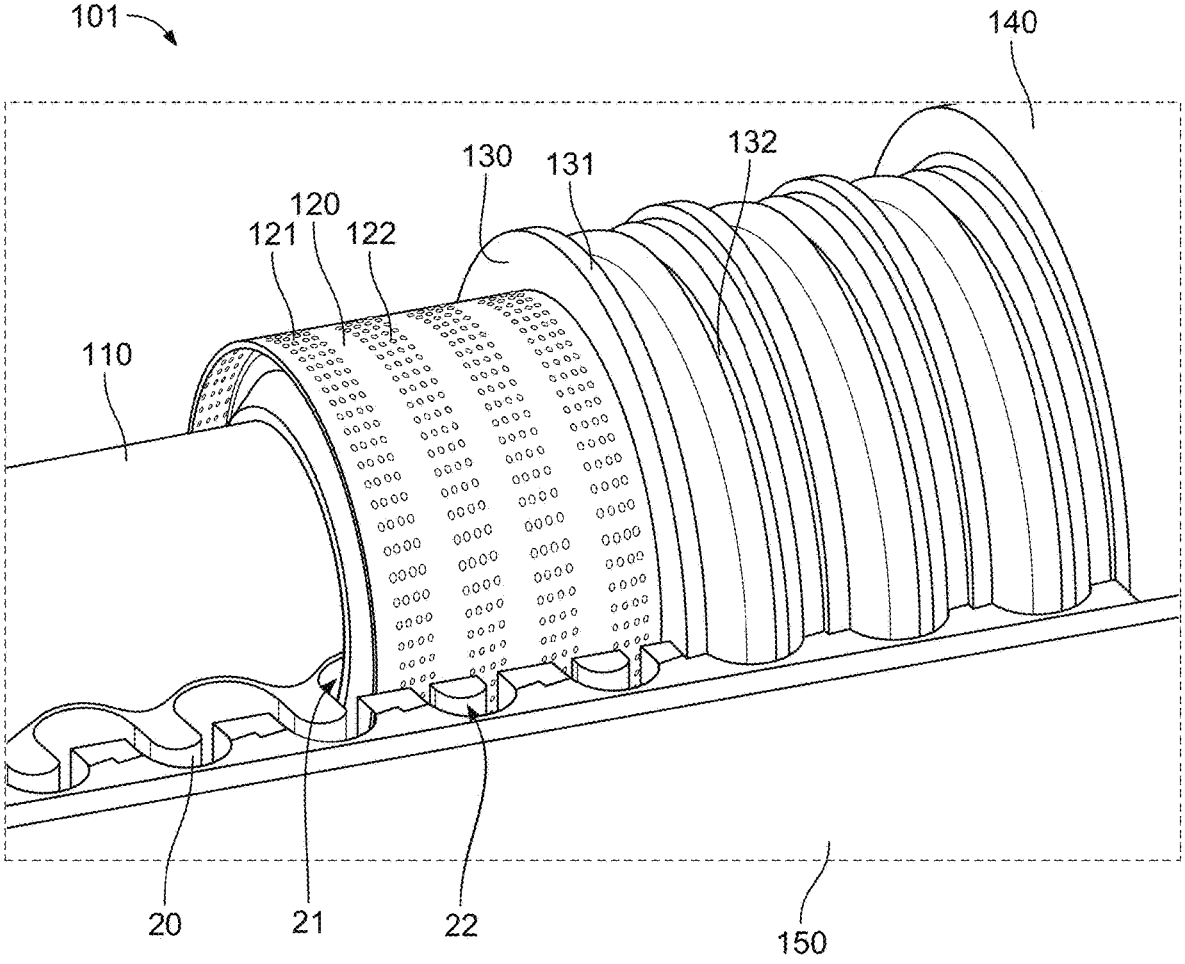
FIG. 1B is a detailed cut-away view of the interior components of the cavitation boiler of FIG. 1A.

FIG. 1A is a cut-away view of a cavitation device 10 including cavitation boiler 100 installed in the chassis of a multi-stage pump assembly. The assembly 10 includes an upstream housing 17 with an inlet 12, a downstream housing 14 with an outlet, and an input 15 shaft passing through the upstream housing 17 and the downstream housing 14. The upstream housing 17 and the downstream housing 14 each include a motor 16 coupled to the input shaft 15 and an interior volute (not shown) configured to fluidly connect the corresponding inlet 12 and outlet 13 with an outlet port 11 to the cavitation boiler 100. In operation, fluid is pumped into the inlet 12 and through a fluid passageway of the cavitation boiler 100 (as shown in more detail in FIG. 1B), and out the outlet 13. At a basic level, the cavitation boiler 100 includes a rotating inner drum fixed to the input shaft 15 and a stationary outer drum 150, which is secured at opposite ends to the upstream housing 17 and the downstream housing 14, which are themselves fixed in place by tension rods 18. Rotor segments 120 are fixed to the rotating inner drum 110 and each rotor segment 120 spins inside a stator drum 130 fixed to the outer drum 150 by a stator casing 140. A torturous fluid passageway is created through each rotating rotor segment 120, into a corresponding stator drum 130, and back into a downstream rotor segment 120, which defines a continuous fluid passageway through the cavitation boiler 100, as shown in FIG. 1B. When a fluid passes between the rotating rotor segment 120 and into the stator segment (which includes a stator drum 130 and a stator casing 140), it passes through a cavitation region created by two sets of apertures rotating with respect to each other—one set in the rotor segment 120, and a corresponding set in the stator drum 130. When the fluid moves between the rotor segment 120 and the stator drum 130, it does so through the two sets of apertures, which induces cavitation in the fluid in a small region between the rotor segment 120 and the stator drum 130.

FIG. 1B is a detailed cut-away view of the interior components of the cavitation boiler 100 of FIG. 1A. As detailed above, the rotating inner drum 110 spins attached rotor segments 120 inside of stationary stator drum 130 that surrounds the rotor segments 130. Each rotor segment 120 includes an exterior drum surfacing having two annular sets of apertures 121, 122 through the drum. Around each rotor segment 120, is positioned a stator drum 130, with a two corresponding set of annular apertures 131, 132 positioned above (e.g., in the radial direction) the apertures 121, 122 of the rotor segment 120. In this configuration, a fluid passageway is created between each set of the apertures 121, 122 of the rotor segment 120 and each corresponding set of the apertures 131, 132 of the stator drum 130. In operation, rotation of the rotor segment 120 inside the stator drum 130 spins the rotor's apertures 121, 122 inside of the stator's apertures 131, 132. In some instances, a small gap exists between the rotor segment 120 and the stator drum 130.

FIG. 1B shows a cut-away of the fluid passageway 20 through the cavitation boiler 100, which includes a rotor fluid passageway 21 and a stator fluid passageway 22. The rotor fluid passageway 21 is illustrated as an annular interior chamber in the rotor segment 120 that enables fluid in the rotor fluid passageway 21 to pass through the apertures 121, 122 of the rotor segment 120. The stator fluid passageway 22 is illustrated as an annular interior chamber in the stator drum 130 that is created by two grooves in the stator drum 130 (e.g., the location of the stator's apertures 131, 132) being enclosed by the stator casing 140 to form the stator fluid passageway 22 that fluidly connects the two sets of the apertures 131, 132 of the stator drum 130. In operation, fluid enters the rotor fluid passageway 21 in an open face of a first rotor segment 120 (e.g., an upstream portion), as shown, as flows into the stator fluid passageway 22 by passing across the apertures of the rotor and then the apertures of the stator. This operation induces cavitation in the fluid in a first cavitation region between a first set of apertures 121 of the rotor segment 120 and a first set of apertures 131 of the stator drum 130 when the rotor segment is rotating with respect to the stator drum 130, as explained in more detail below. The fluid in the stator fluid passageway 22 is directed from the first set of apertures 131 to the second set of apertures 132, where the fluid then passes through a second cavitation region between a second set of apertures 132 of the stator drum 130 and a second set of apertures 122 of the rotor segment 120. The fluid re-enters the rotor segment 120 into a downstream portion of the rotor fluid passageway that is separate from the upstream portion the fluid first entered. In this downstream chamber of the rotor segment 120, the fluid freely passes to the upstream portion of the rotor fluid passageway 21 in an adjacent (e.g., downstream) rotor segment 120, and the process repeats until the fluid exists the cavitation boiler 100, as shown in FIG. 2.

Figure 2:
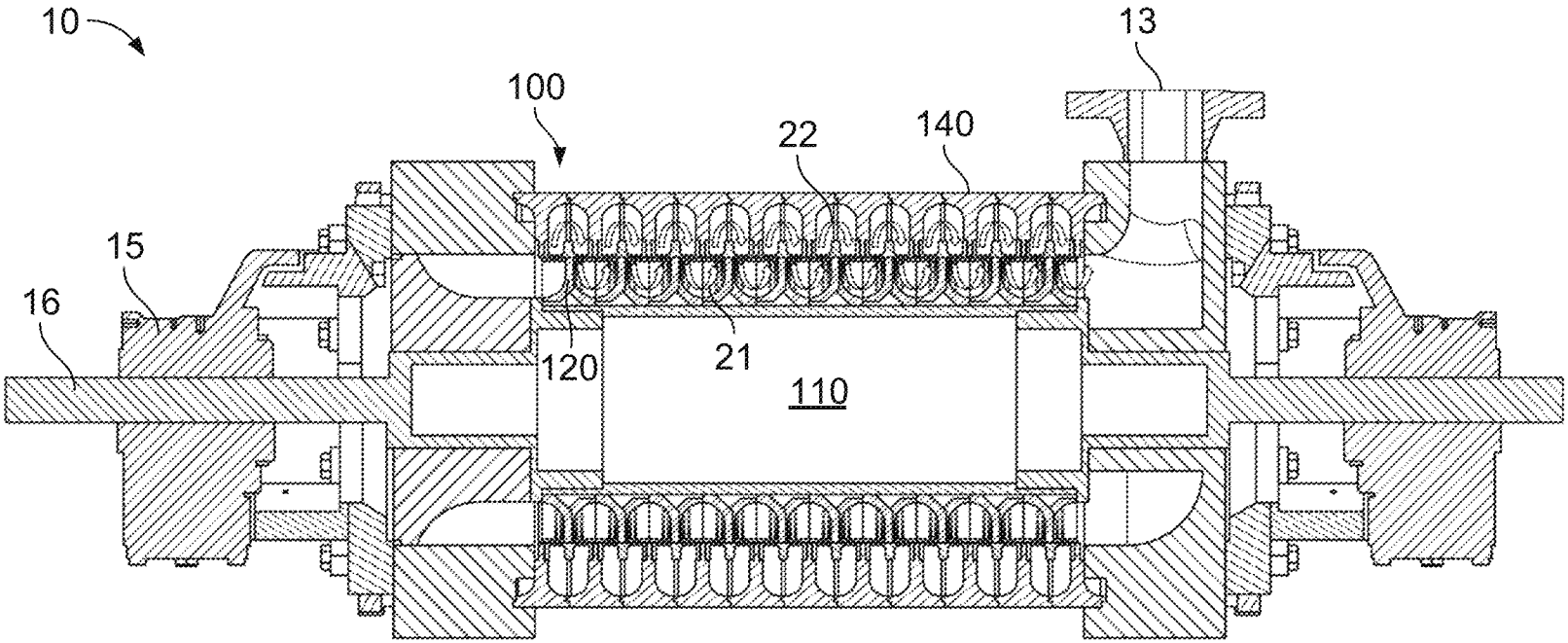
FIG. 2 is a cross-section illustration of a cavitation boiler.

FIG. 2 is cross-section illustration of the cavitation boiler 100 with the outer drum 150 not shown. In FIG. 2, the fluid passageway 20 through the cavitation boiler 100 is illustrated as arrows showing alternating of the rotor fluid passageways 21 and stator fluid passageways 22, which are connected across cavitation regions, as described above. In contrast to impeller driven cavitation systems, the present cavitation boiler 100 removes unneeded weight and rotational resistance. In general, impellers are designed to move water, but in some instances, the rotor segments 120 and stator segments 130, and as illustrated, are not configured to pump the fluid through the cavitation boiler 100. In some instances, a source of pressurized fluid (e.g., a pump upstream of the inlet 12, or a pump segment upstream of the cavitation boiler 100) drives the fluid through the cavitation boiler 100, which results in less input power supplied to the input shaft 16 to reach an ideal RPM for the rotor segments 120. In some instances, pumping segments can be interposed between rotor segments 120 to apply pressure to drive the fluid through the cavitation boiler. In some instances, a pumping segment or pumping section is placed as a first segment of the cavitation boiler 100 and eliminates or reduces the pressure necessary on the fluid prior to the inlet 12.

The design of the rotor segment 120 minimizes the amount unwanted movement of fluid in the fluid passageway 20, which focuses the work applied (e.g., by the input shaft 16 in the form of cavitation) to the area where the maximum amount of energy can be applied. For instances, a shorter overall path of travel for fluid through each rotor segment 120 and stator segment (e.g., the stator drum 130 and the stator casing 140) increases a ratio of cavitation region to overall flow path of travel for the fluid through the fluid passageway 20. Because work is required to pump the fluid through the entirely of the fluid passageway 20 (e.g., in addition to the force required to advance the fluid across the cavitation regions), increasing the ratio of the cavitation region to overall flow path through the fluid passageway 20 increases the efficiency of creating cavitation from a given power input to the input shaft 16.

In some instances, the rotor segment 120 is designed such that it is able to utilize the inlet side of a single chamber and the outlet side while maintaining an axial fluid flow through each adjacent rotor/stator sets. A typical centrifugal pump includes an impeller with a suction side and a discharge side. On the discharge side, the fluid is routed back to the suction of the next impeller inline. Aspects of the present disclosure enable the second stage be where typically only a channel moving water to the second stage is in a conventional set up. In some instances, examples of the present disclosure more than double the amount of cavitation capacity in a given axial distance compared to a centrifugal design. In some instances, an existing chassis of a centrifugal design went from 6 to 20 stages of capacity in the same given space using examples of the present rotor/stator design. In some instances, the present cavitation boiler 100 design allows for subassemblies of rotor segments 120 and stator segments of individually high tolerance assemblies to be manufactured prior to final assembly, unlike typical multi-stage centrifugal designs. As stated previously, given some number of individual rotors/stators that are machined to some tolerance and then "stacked" together in an assembly, a stack up tolerance can put the entire assembly out of tolerance. Aspects of the present design enables all stage to be assembled and then machined as an assembly thereby eliminating any stack up possibility and holding an overall tolerance. This allows the new design to maintain much tighter tolerances (e.g., 0.005", or 0.1" to 0.002", 0.002" to 0.05", or as low as 0.002") over a longer axial distance. Some examples of the present design enable easier maintenance of the internals of the cavitation boiler 100 because the rotor segments 120 are not be "locked" into individual stages like a typical multi-stage centrifugal design. In contrast, and entire rotor segment 120 can be removed from inner drum 110 at a discharge end of the pump without disassembly of the stator/casing assemblies and the stator assembly would remain stationary while the rotor assembly is removed. In a typical ring-section pump, the entire assembly is held together by the tension rods 18 that are used to "squeeze" the midsection together. The tension rod 18 would be removed and rotor segments 120 would be removed by pulling the whole shaft assembly out through an opening in the suction or discharge chambers. In some examples, the cavitation boiler 100 includes a pumping segment (e.g., an impeller section pump), which is much easier to seal than a split case type design or similar. In some instances, the first stage in the cavitator boiler is an actual impeller that acts just as a normal pump impeller would and is sized to provide the exact flow and pressure at the operating rpm that the system would require to operate. In some instances, the inclusion of an initial impeller pump removes the need for a separate circulation pump and drive and makes the overall system smaller and more compact.

Figure 3A:
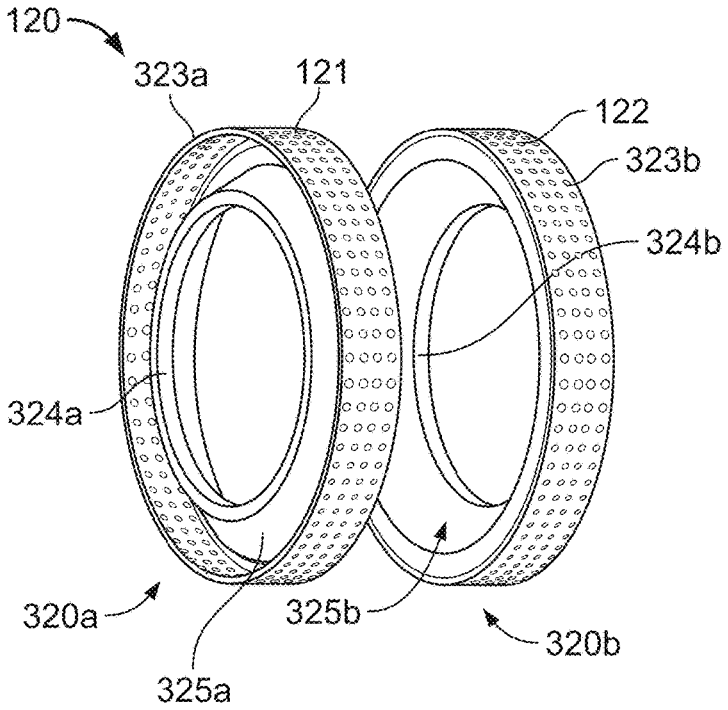
FIGS. 3A and 3B are illustrations of a rotor segment.
Figure 3B:
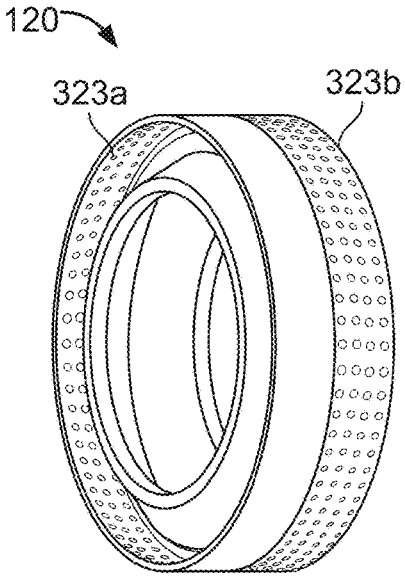

FIGS. 3A and 3B are illustrations of a rotor segment 120. The rotor segment 120 may be constructed from two rings, e.g., an upstream ring 320*a* and a downstream ring 320*b*, where each ring 320*a,b* includes a drum portion 323*a,b* that includes one set of the two sets of apertures 121, 121. Splitting the rotor segment 120 into two rings 320*a,b* may significantly reduce the manufacturing costs of the rotor segment 120. However, in some instances, the rotor segment 120 is constructed from a single piece of material. Each ring 320*a,b* is configured to be secured to the inner drum 110 by a hub portion 324*a,b* that slides over and interfaces with the outer surface of the inner drum 110. A web portion 325*a,b* connects the drum portion 323*a,b*, to the hub portion 324*a,b*, and the web portion 325*a,b* defines a surface of an inner chamber of each ring 320*a,b*, where each chamber defines a portion of the rotor fluid passageway 21. Generally, the notion rotor fluid passageway 21 refers to the chamber created by two inner adjacent inner chambers, one in a downstream ring 320*a* and one in an upstream ring 320*b*, with the exception that the first and last ring of the cavitation boiler 100 will not have an adjacent rotor segment 120 and the inner chamber without an adjacent rotor segment 120 is an annular open faced chamber of the rotor segment 120 and, in some instances, enables an initial inflow or final outflow of fluid from the cavitation boiler 100. As illustrated, the web portion 325*a,b* and the drum portion 323*a,b* define an annular chamber in the ring 320*a,b* below the drum portion 323*a,b* that is configured to mate with an adjacent rotor segment 120 to create the rotor fluid passageway 21. In operation, this enables fluid to flow from the annular chamber in the downstream ring 320*b* the annular chamber in an adjacent upstream ring 320. FIG. 3B illustrates the upstream ring 320*a* and the downstream ring 320*b* in their installed configuration on the inner drum 110 (not shown). In some instances, the rings 320*a,b* include mating features (not shown) to, in one example, secure the upstream ring 320*a* and the downstream ring 320*b* of the same rotor segment 120 to each other, or, in another example, secure a rotor segment 120 to an adjacent rotor segment.

Figure 4:
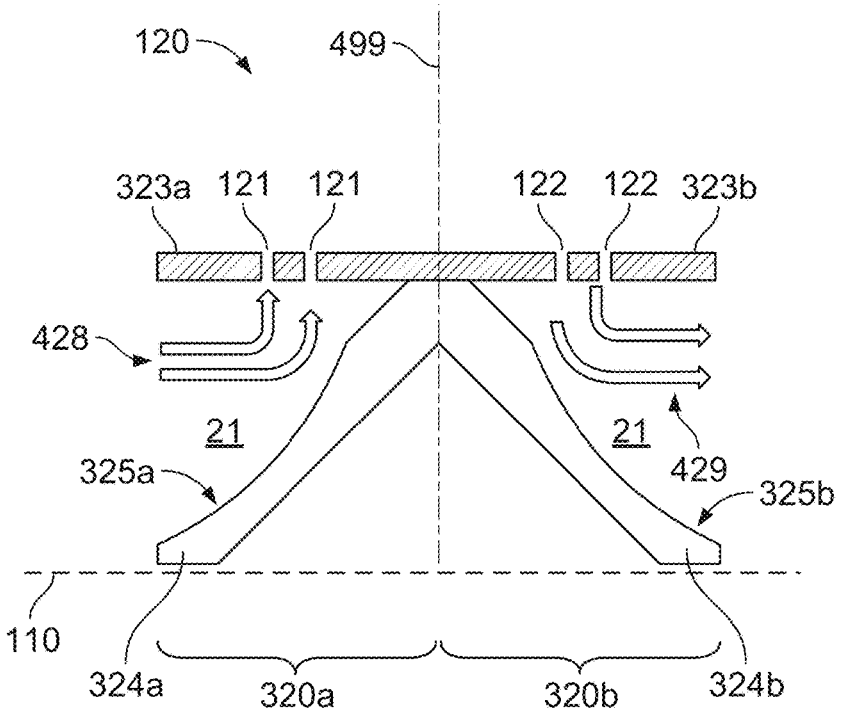
FIG. 4 is a cross-sectional diagram of a rotor assembly.

FIG. 4 is a cross-sectional diagram of a rotor segment 120. FIG. 4 shows a cross section of the upstream ring 320*a* and the downstream ring 320*b*, where each ring 320*a,b* includes the drum portion 323*a,b* that includes one set of the two sets of apertures 121, 121, the web portion 325*a,b*, and the hub portion 324*a,b*. The inner drum 110 is shown as a dotted line and FIG. 4 illustrates the rotor segment 120 installed around the inner drum 110. Also shown is the a dotted line 499, indicating that, in some instances, the rotor segment 120 is comprised of the two separate rings 320*a,b*. In other instances, the rotor segment 120 is a single solid ring.

In operation, an inflow of fluid (shown as arrows 428) enters an upstream portion of the rotor fluid passageway 21 in the upstream run 320*a*, and is directed by the surface of the web portion 325*a* in a radially outward direction (as indicated by the bend in the arrows 428) against the drum portion 323*a*, where it passes through the apertures (e.g., the first set of apertures 121) and leave the upstream ring 320*a*. Once the flow leaves upstream ring 320*a* of the rotor segment 120, is returned to the downstream ring 320*b* after passing through the stator 130 a one or cavitation regions between the rotor assembly 130 and the stator 130, as explained in more detail below. From the stator 130, an outflow of fluid (represented by arrows 429) passes through the apertures (e.g., second set of apertures 122) in the drum portion 323*b* and into a downstream portion of the rotor fluid passageway 21, and is directed by the surface of the web portion 325*b* in a generally axial direction (as indicated by the bend in the arrows 429) out of the downstream ring 320*b*. From here the fluid may flow to, for example, an adjacent upstream ring 320*b*, another component of the cavitation boiler 100, or to the outlet port 11 of the downstream housing 14 in order to flow out of the assembly 10 through the outlet 13. In some instances, the rotor segment 120 does not do any work to the fluid flowing into and out of the rotor segment 120, and merely serves to direct the flow into the first set of apertures 121 from an adjacent upstream component, and direct flow from the second set of apertures 122 into an adjacent downstream component. In some instances, the rotor segment 120 includes fins or impeller portions in one both of the upstream and downstream portions of the rotor fluid passageway 21 in order to assist in the fluid transport described above.

Figure 5A:
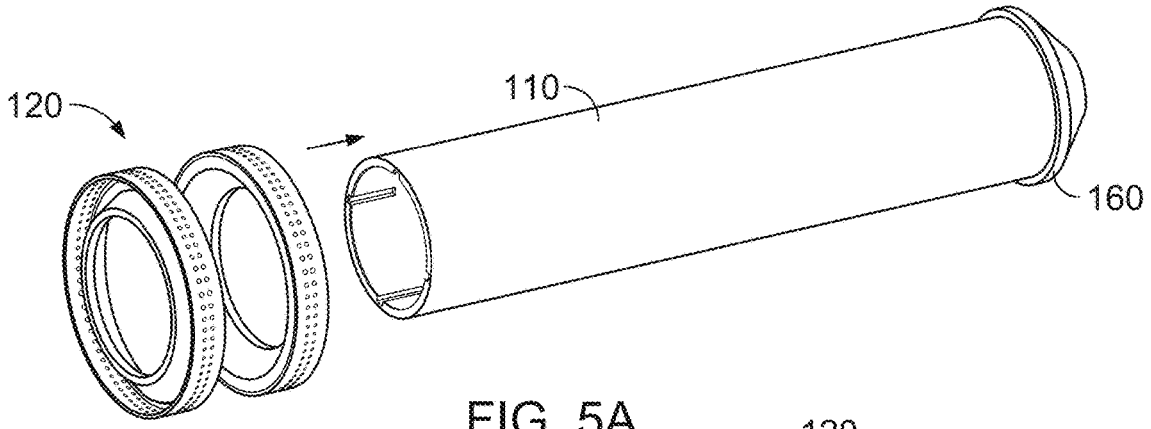
FIG. 5A-5D are illustrations showing assembly of a rotor assembly from individual rotor segment on an inner drum.
Figure 5B:
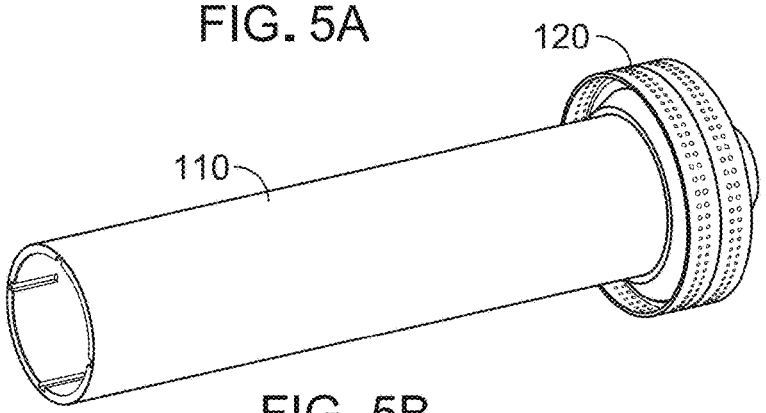
Figure 5C:
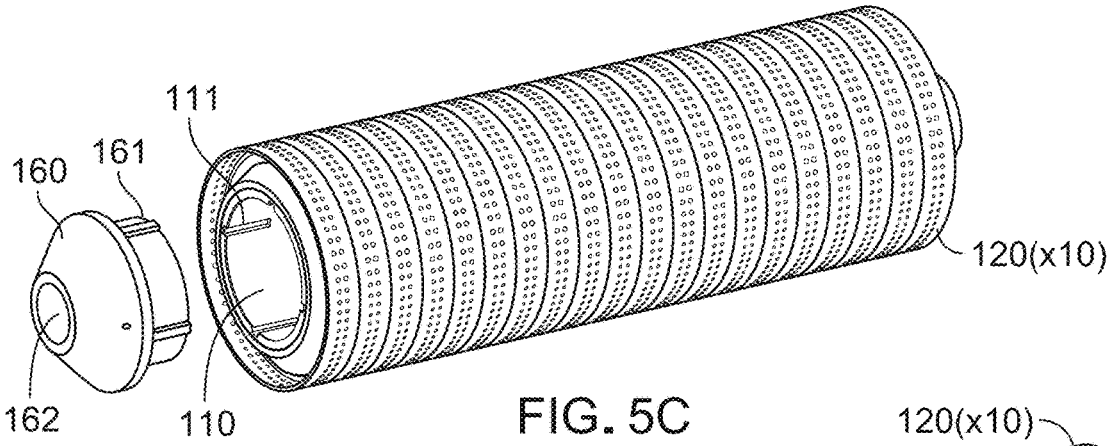
Figure 5D:
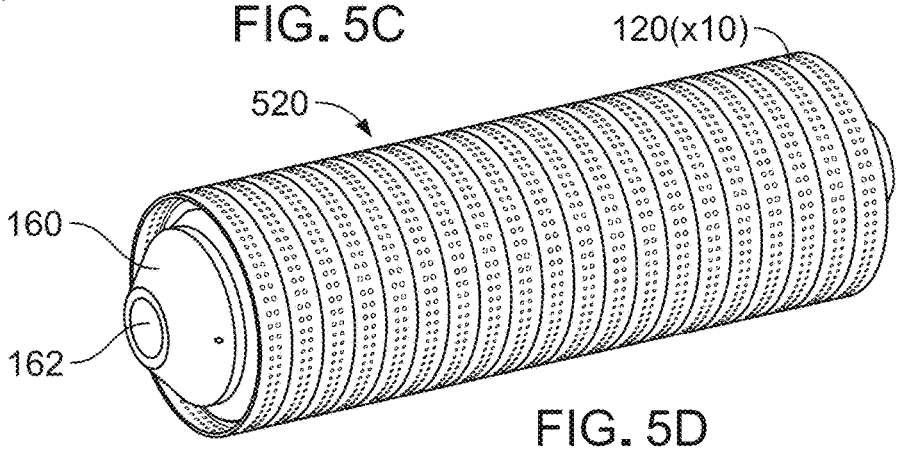

FIG. 5A-5D are illustrations showing assembly of a rotor assembly 520 from individual rotor segments 120 on the inner drum 110. FIG. 5A illustrates a rotor segment 120 (including an upstream ring 320*a* and a downstream ring 320*b* as shown in FIG. 3) being introduced to an end of the inner drum 110. The opposite end of the inner drum 110 is capped by an end cap 160 which serves to axially secure the rotor segments 120 to the inner drum, as shown in FIG. 5B. FIG. 5C illustrates ten rotor segments 120 installed along the length of the inner drum 110 and the second end cap 160 about to be secure to the inner drum 110 to complete the rotor assembly 520. As shown, the inner drum 110 is substantially hollow and includes grooves 111 cut into the open end. The end cap 160 includes a cylindrical portion that fits concentrically into the open end of the inner drum 110 and includes ridges 111 that rotationally couple the end cap 160 to the inner drum 110. The coupling of the end cap 160 to the inner drum 110 enables the end caps 160 to secure the rotor assembly 520 to the input shaft 15, which delivers a torque to the rotor assembly 520 to spin the completed rotor assembly 520, as illustrated in FIG. 5D, in the cavitation boiler 100.

Figure 6B:
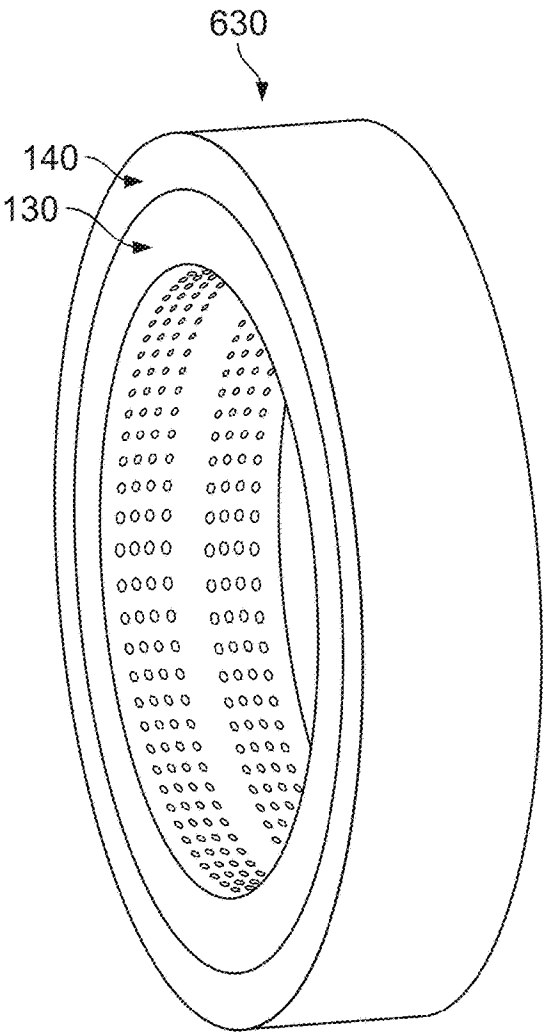
FIGS. 6A and 6B are illustration of a stator segment including a stator and a stator casing.
Figure 6A:
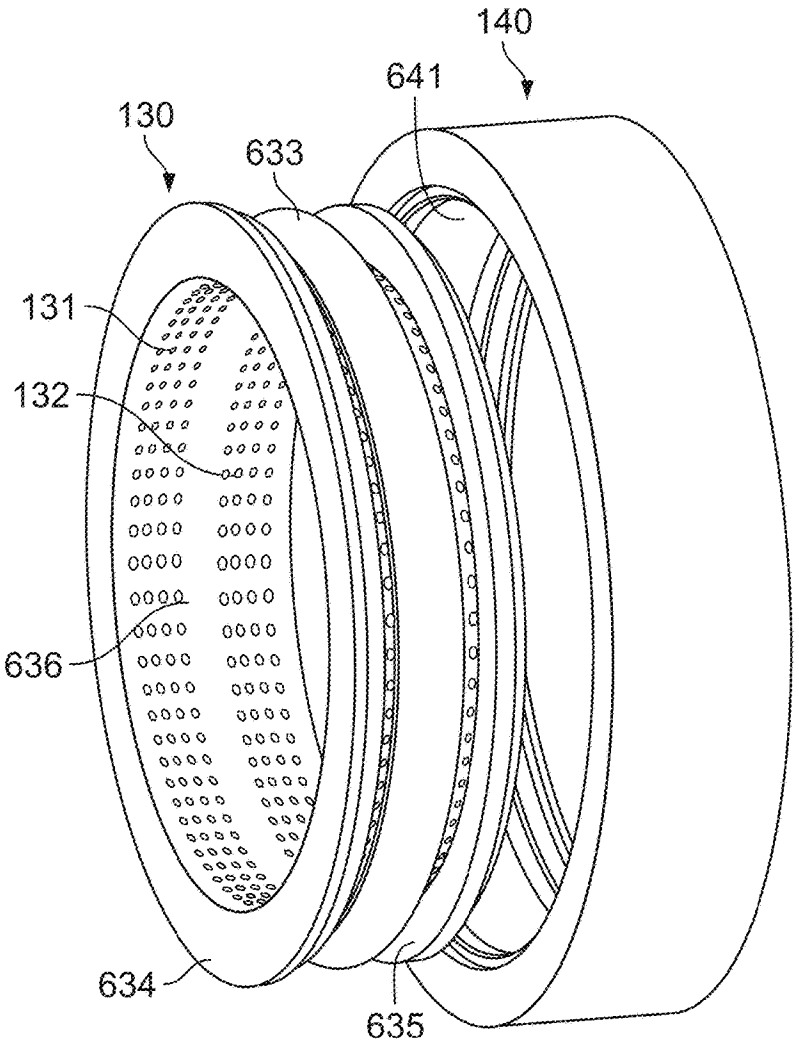

FIGS. 6A and 6B are illustration of a stator segment 630 including a stator 130 and a stator casing 140. FIG. 6A shows a stator drum 130 prior to insertion in a stator casing 140 to form the stator segment 630. The stator drum 130 includes a cylindrical drum surface 636 where the two sets of apertures 131, 132 are formed. As shown, each set of apertures 131, 132 is four parallel annular rows (e.g., banks) of apertures formed through the drum surface 636. In some instances, the apertures have more or less than four rows of apertures, and the spacing between each row of each set 131, 132 may vary. The opposite side of the drum surface 636 includes a raised region 633 defining an inner surface of the stator flow path (22 of FIG. 1B) between the first set of apertures 131 and the second set of apertures 132 inside the stator segment 630. The stator drum 130 includes an upstream flange 634 and a downstream flange 635, each configured to seal the stator drum 130 to the stator casing 140, as shown in more detail in FIGS. 7A-7C. Finally, FIG. 6A also shows the stator casing 140 includes a curved region 641 configured to be opposite the raised region 633 when assembled, and the curved region defines an outer surface of the of the stator flow path (22 of FIG. 1B). FIG. 6B shows the stator drum 130 inserted into the stator casing 140, as shown in more detailed in FIG. 7C.

Figure 7A:
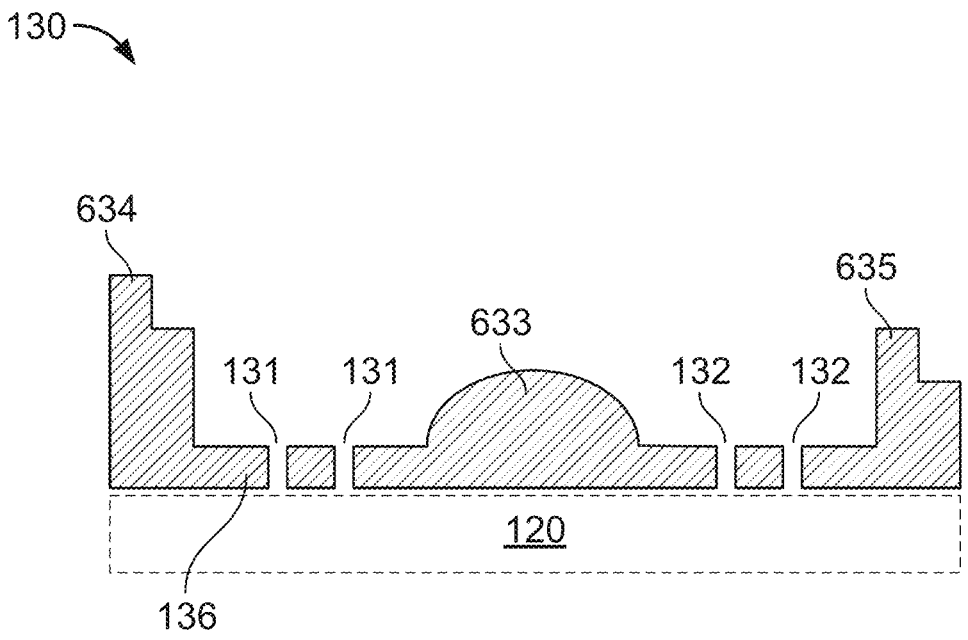
Figure 7B:
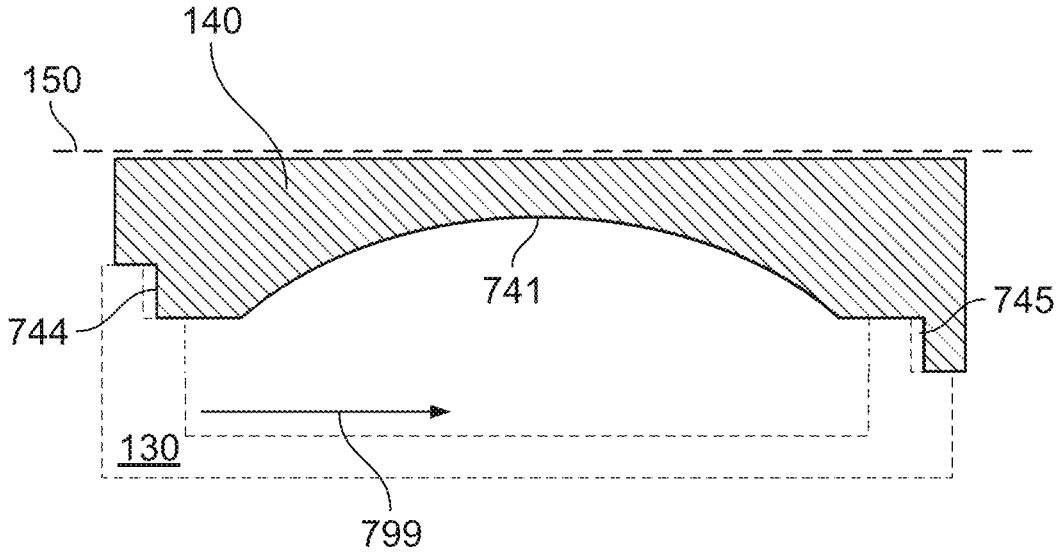
Figure 8A:
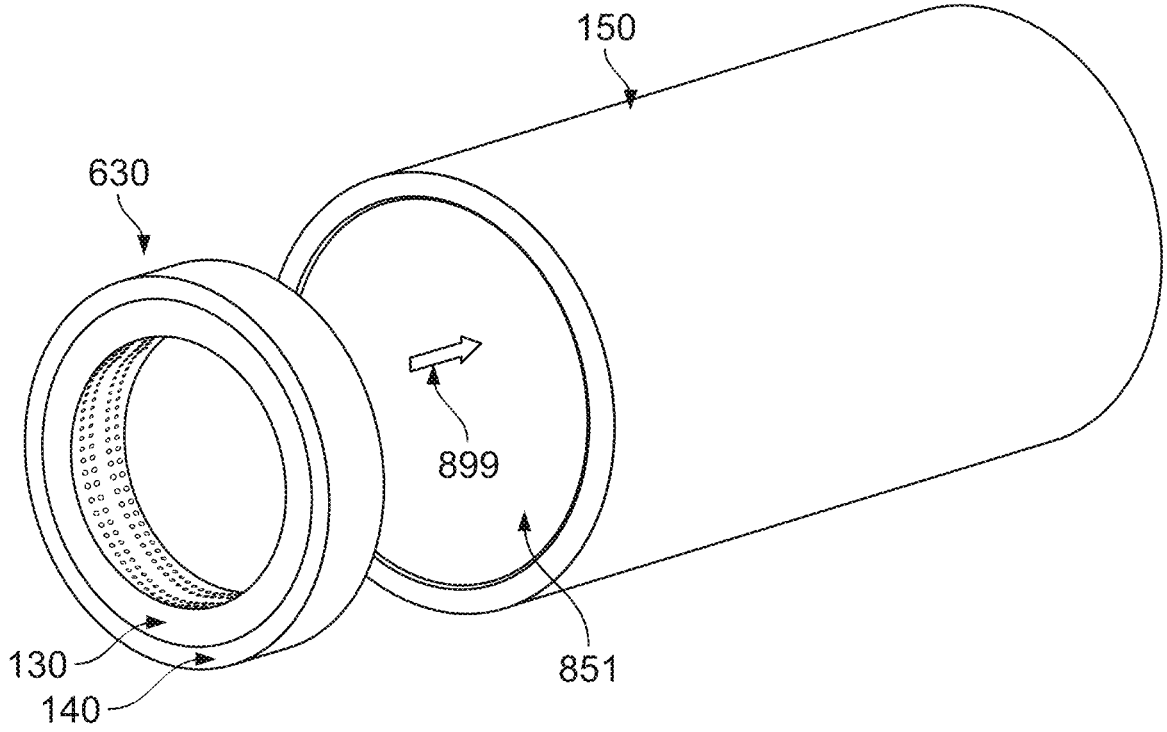
FIGS. 8A and 8B are illustrations showing assembly of a stator assembly from individual stator segments inside an outer drum.
Figure 8B:
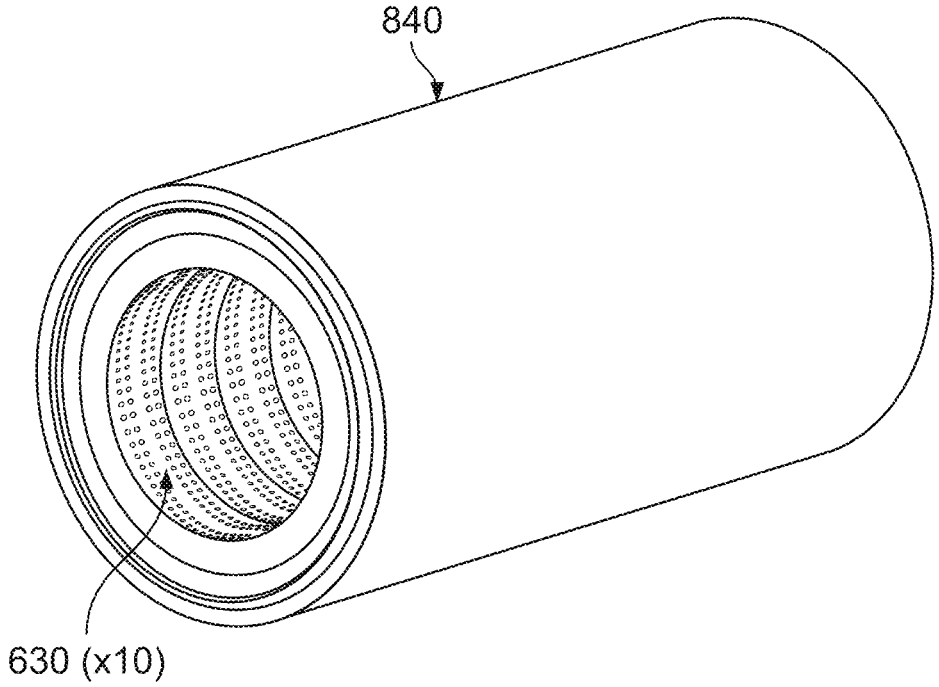

FIGS. 7A-7C are cross-sectional diagrams of the stator segment 630. FIG. 7A shows the stator drum 130 positioned around a rotor segment 120 (illustrated as a dotted box). This is shown for illustrative purpose only, as the stator drum 130 is, in some examples, assembled with the stator casing 140 prior and then into a stator assembly (840 as shown in FIGS. 8A and 8B), prior to the stator drum 130 being adjacent to a stator assembly. As shown, the stator drum 130 includes an upstream flange 634 that with a step to seal against a corresponding step (744 of FIG. 7B) in the stator casing 140 and a downstream flange 635 also with a step to seal against a corresponding step (745 of FIG. 7B) in the stator casing 140. The height of the step in the upstream flange 634 is greater than the height of the downstream flange 635 to enable the stator drum 130 to slide into the stator casing without interference, as illustrated in FIG. 7B. FIG. 7B shows the stator drum 130 being inserted axially into the stator casing 140, as indicated by arrow 799. Similar to the rotor assembly 120 being shown in FIG. 7A, the final position of the outer drum 150 is illustrated in FIG. 7B, but, in some instances, the stator drum 130 and stator casing 140 are assembled together prior to insertion into the outer drum 150, as detailed below. In operation, the upstream and downstream flanges 634, 635 contact the corresponding steps 744, 745 annularly around the stator casing 140 and define a portion of the stator fluid passageway 22 in each stator assembly 630, as shown in FIG. 7C. FIG. 7C is a cross-section of an assembled stator segment 630 showing the stator fluid passageway 22 and the flow of fluid (indicated by arrow 739) from the first set of apertures 131 to the second set of apertures 132. In operation, fluid from a spinning rotor segment 120 (which is illustrated for simplicity as a dotted line) into the stationary stator segment 630 through the first set of apertures 131. Past the first set of apertures 131, the fluid is deflected by the curved region 641 of the stator casing 140 to pass through the second set of apertures 132. The raised region 633 of the stator drum 130 defines a lower portion of the stator fluid passageway 21 and is configured to turn the fluid through the stator fluid passageway 21 to decrease resistance and turbulence prior to entering the next section.

Alternatively, as shown in FIGS. 7D and 7E, each stator segment 630 is not constructed to contain a complete section of the stator fluid passageway 22, but instead each stator segment defines two separate halves of the stator fluid passageway 22, similar to the construction of the rotor segment 120.

FIGS. 8A and 8B are illustrations showing assembly of a stator assembly 840 from individual stator segments 630 inside an outer drum 150. FIG. 8A shows a stator segment 630, including a stator drum 130 and a stator casing 140, being inserted (arrow 899) into a cylindrical outer drum 150. Each stator segment 630 defines a cylindrical outer surface that is precisely sized to slide against the inner surface 851 of the outer drum 150 with enough friction to be secured in place while the stator assembly 520 rotates inside of the stator assembly 840. Because of this, and similar to the rotor segments 120, each stator segment 630 does not need to be secured to adjacent stator segments 630, and the tolerances between each stator segment 630 therefore do not need to be as precise as the tolerance between the stator segment 630 and the outer drum 150. FIG. 8B shows a completed stator assembly 840, which includes ten stator segments 630 inside of the outer drum 850.

Figure 9:
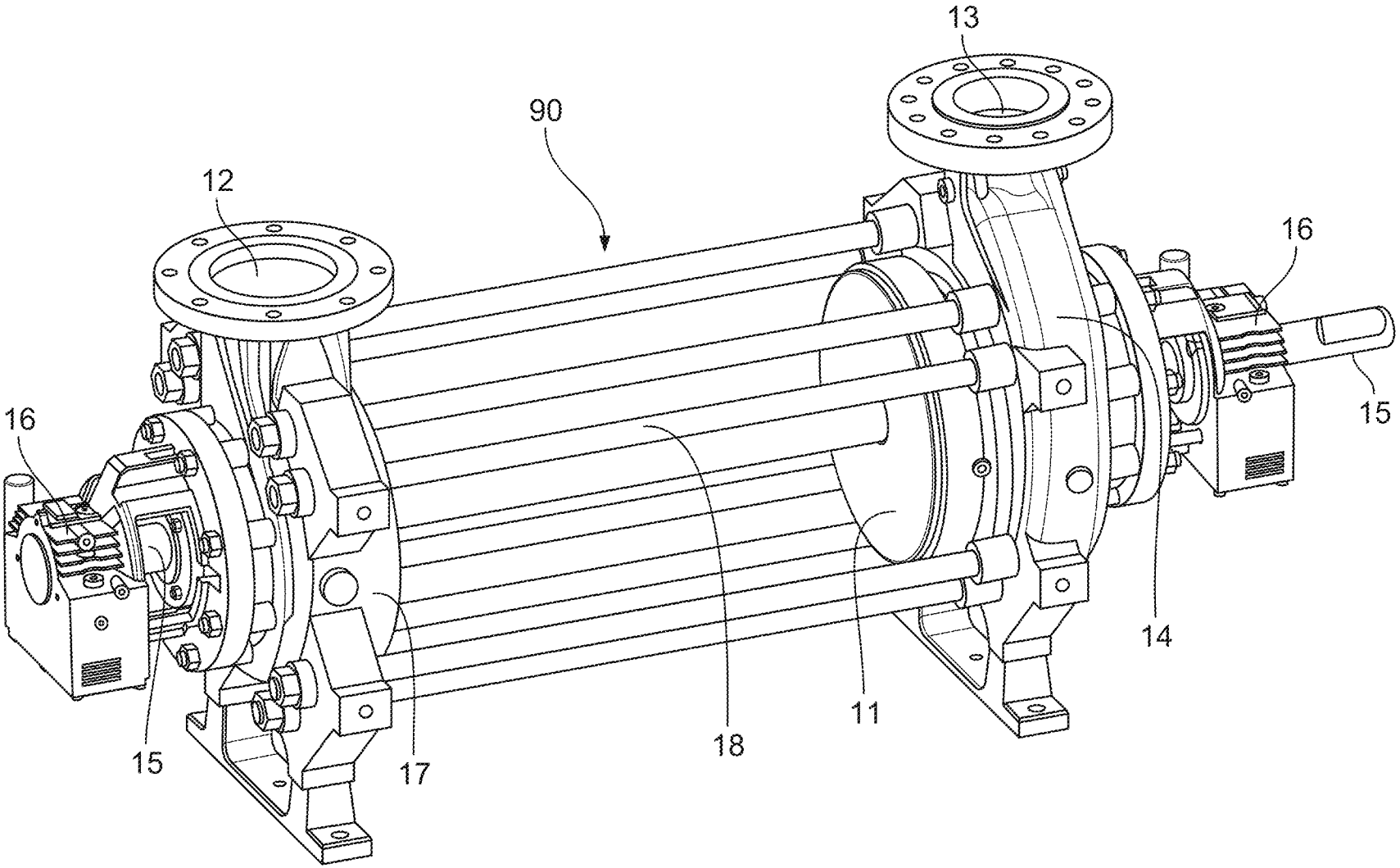
FIG. 9 is an illustration of a multi-stage pump assembly with the pumping stages removed.

FIG. 9 is an illustration of a chassis 90 of a multi-stage pump assembly with the pumping stages removed. In some examples, the cavitation boiler 100 is configured to be secured to the input shaft 15 of an existing multi-stage pump where the pumping components or stages have been removed. As shown in FIGS. 10A-E, the cavitation boiler 100, when assembled into the chassis 90, moves a fluid generally axially along the cavitation boiler 100 in order to take a fluid input to the chassis 90 from the upstream housing 17 to the downstream housing 14.

Figure 10A:
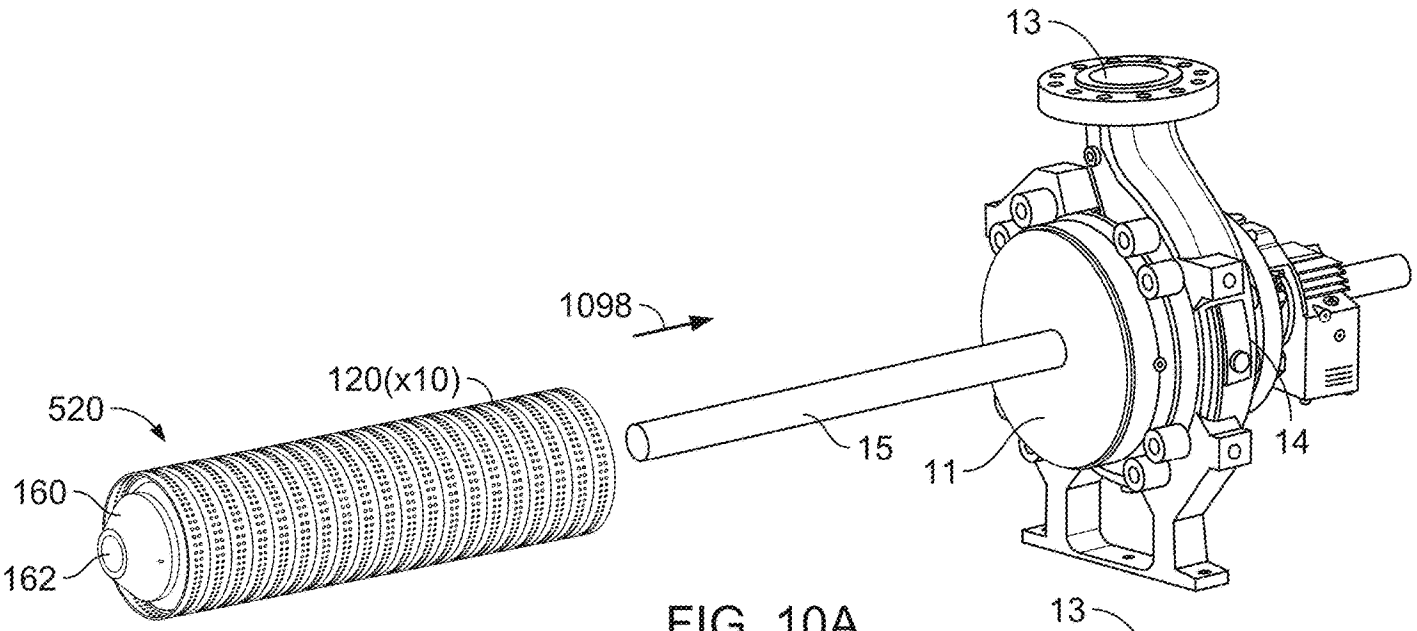
FIGS. 10A-10E are illustrations showing assembly of a rotor assembly and a stator assembly to form a cavitation boiler.
Figure 10B:
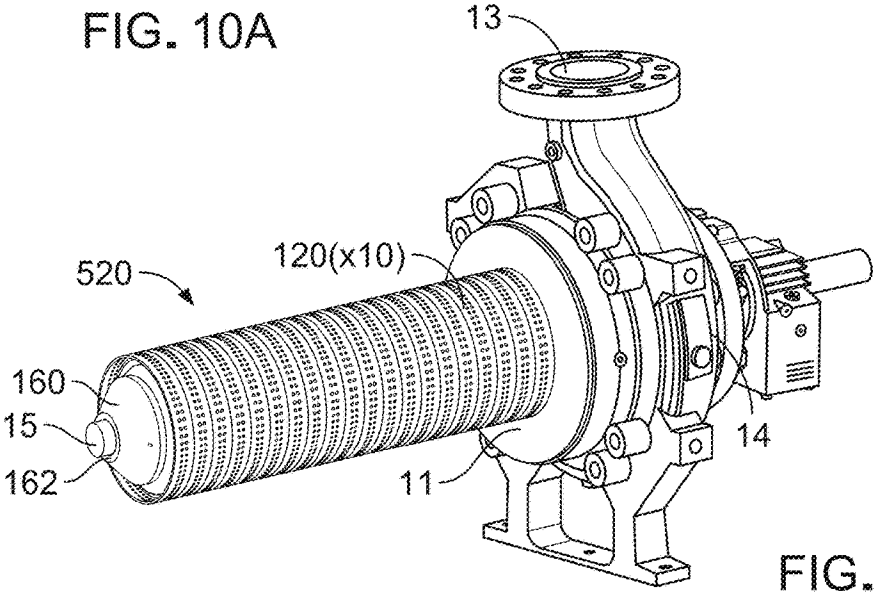
Figure 10C:
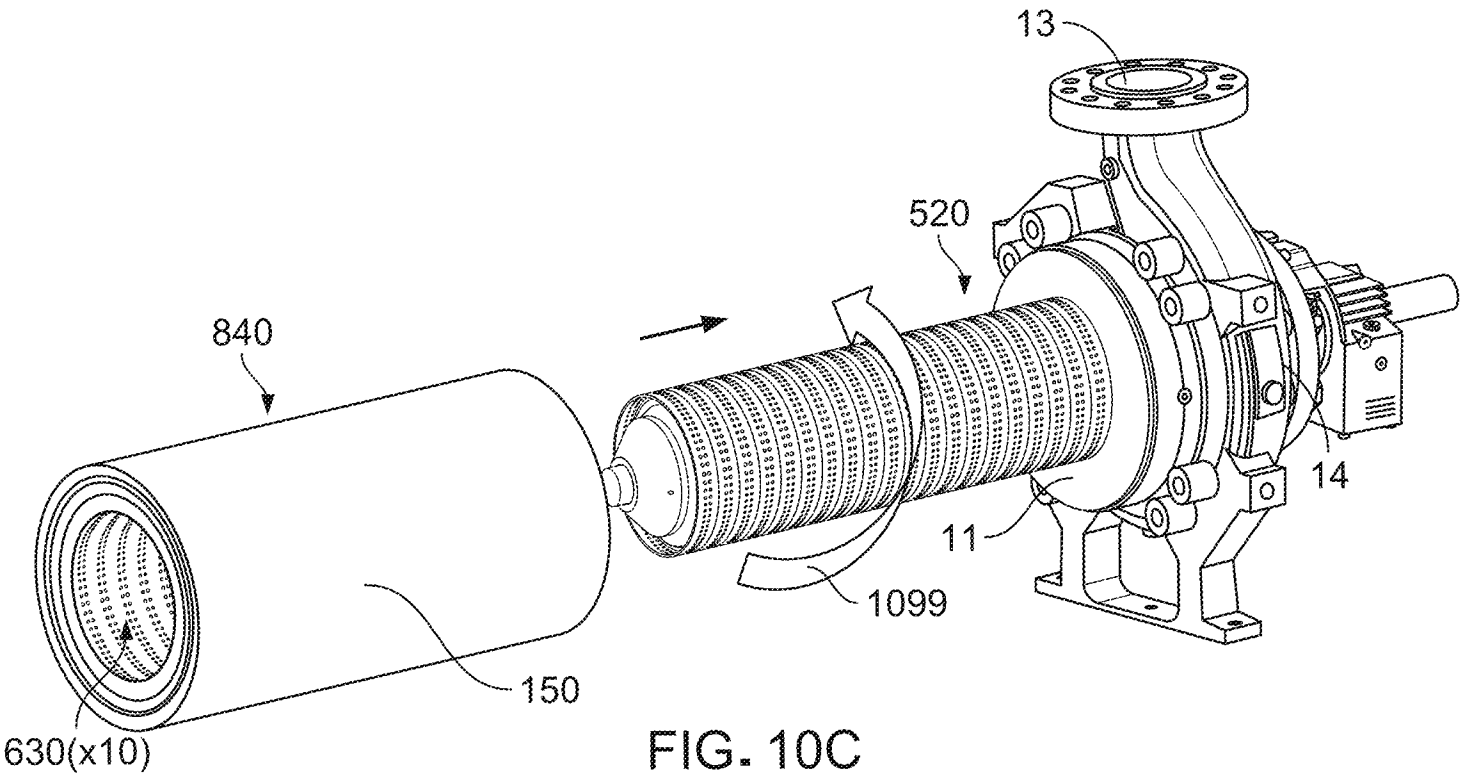
Figure 10D:
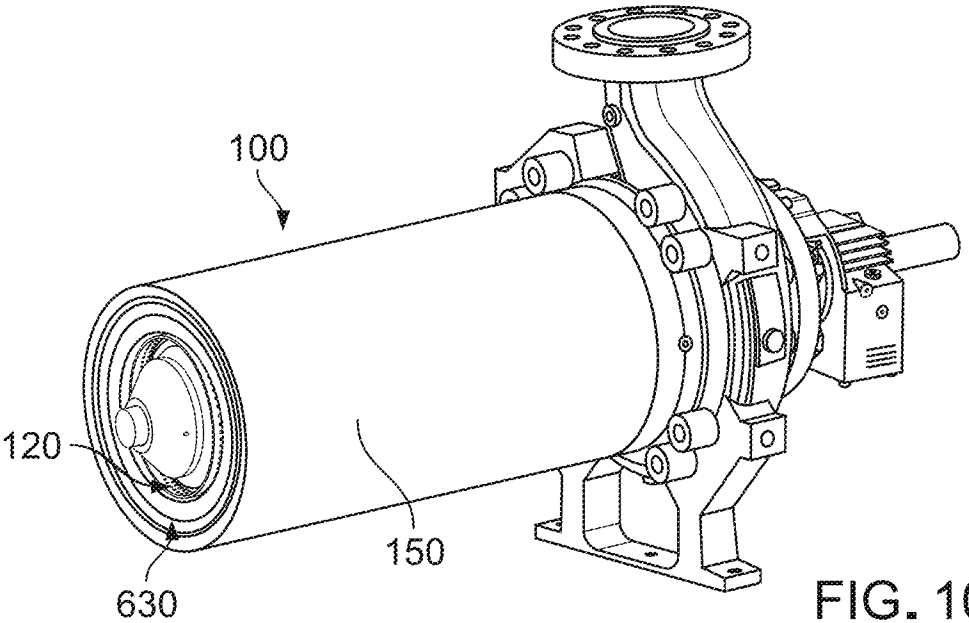
Figure 10E:
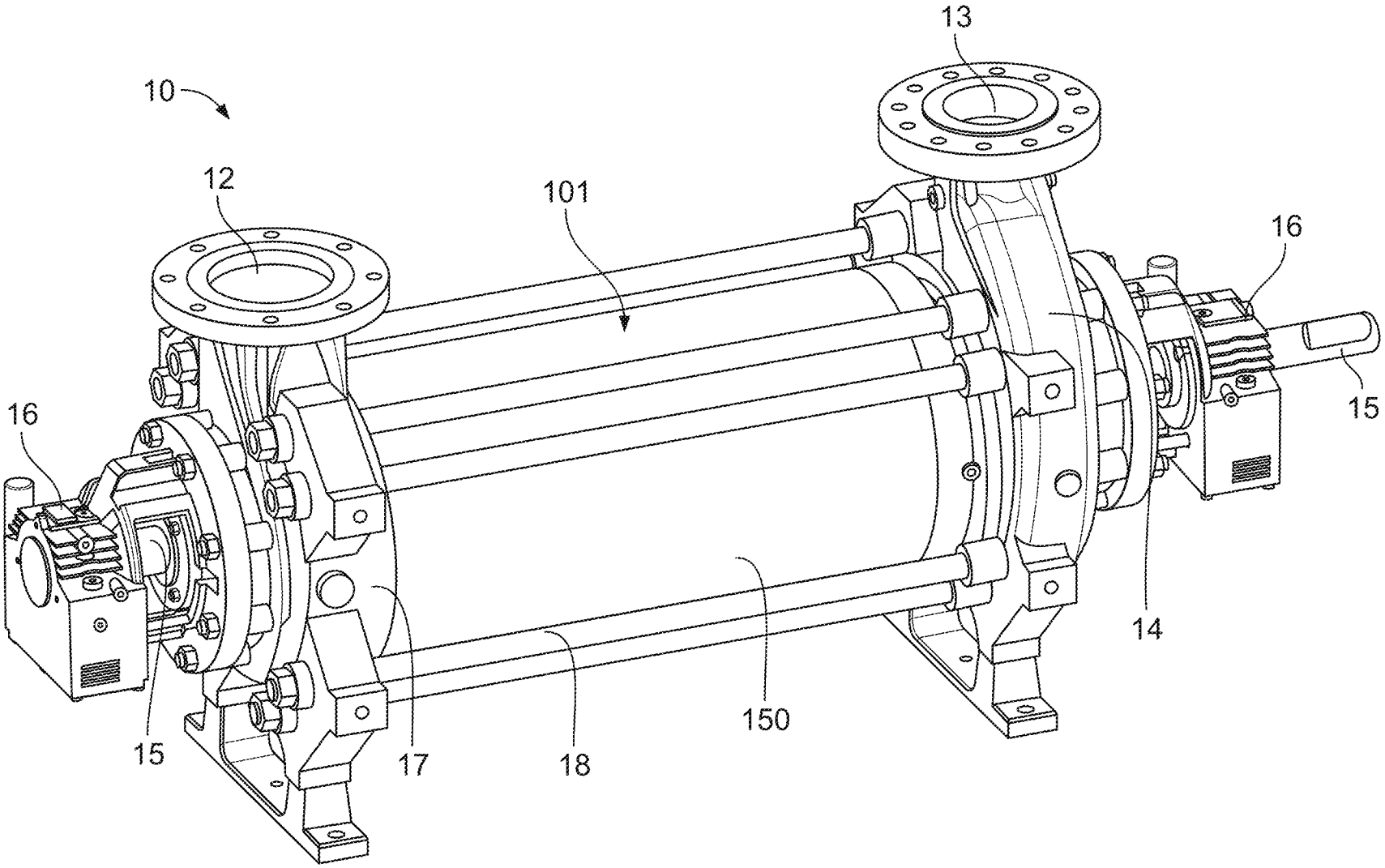

FIGS. 10A-10E are illustrations showing assembly of a rotor assembly and a stator assembly to form a cavitation boiler. FIG. 10A shows the downstream housing 14 and the input shaft 15 of the chassis 90 with the upstream housing 17 removed to allow the rotor assembly 520 to be installed (indicated by arrow 1098) onto the input shaft 15. The installed position of the rotor assembly 520 is illustrated in FIG. 10B, where the end cap 16 is securing the rotor assembly 520 to the input shaft. In some instances, the conic shape of the end cap 16 also serves a functional purpose by directing flow to the upstream ring 320*a* of the first rotor segment 120. In such a configuration, the conical end cap 160 is inserted into the upstream housing 17, and the opposite end cap is similarly inserted into the downstream housing 14. As shown in FIG. 10B, the downstream housing 14 includes an outlet port 11, which is shown as a closed face, but this is typically an open face into an interior volume of the housing 14 where the end cap 160 is positioned. FIG. 10C shows the stator assembly 840 being placed around the rotor assembly 520. The stator assembly 840 is secured to the chassis 90 to enable the rotor assembly 520 to freely rotate (as indicated by arrow 1099) inside of the stator assembly 840. FIG. 10D shows the completed cavitation boiler 100, and FIG. 10E shows the completed assembly 10 with the cavitation boiler 100 secured between the upstream housing 17 and the downstream housing 14 with the tension rods 18 around the outer drum 150.

While FIGS. 10A-10E have shown the cavitation boiler 100 as including 10 corresponding sets of rotor and stator segments 120, 130, alternatively, cavitation boiler 100 may include as few as one set of rotor and stator segments 120, 130 or as many as possible. In other instances, a fluid device may comprise multiple reaction chambers 100 linked together, with each having one or more sets of rotor and stator segments 120, 130.

Figure 11:
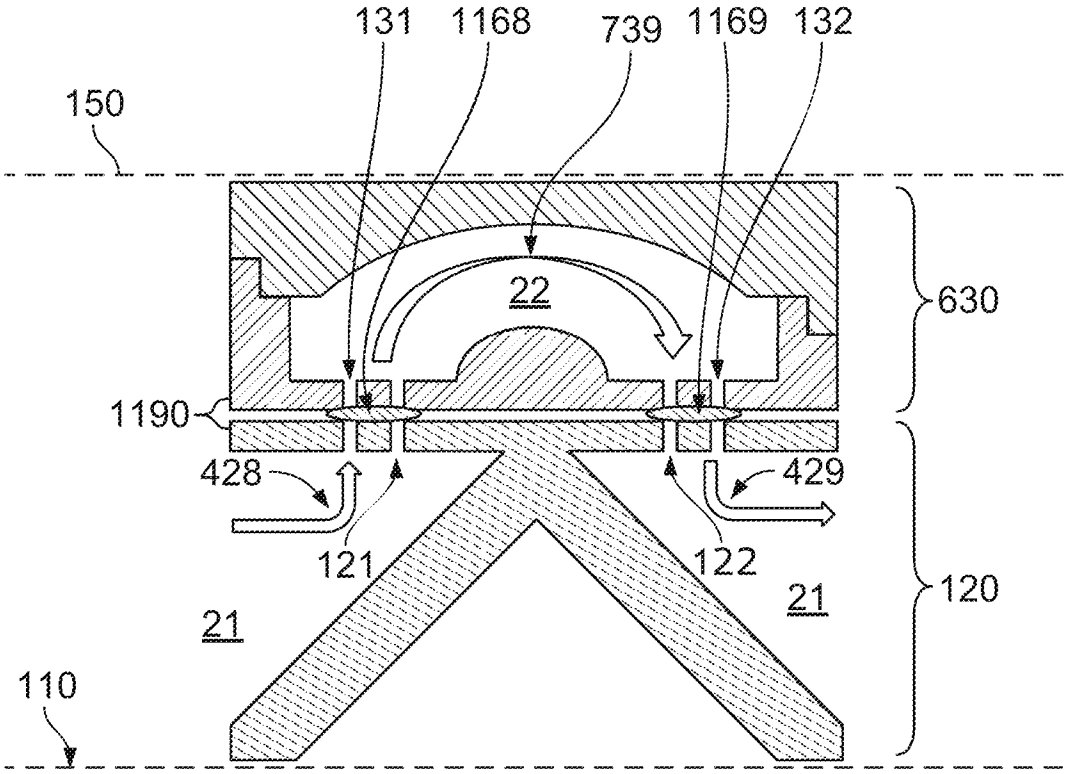
FIG. 11 is a cross-sectional diagram of a stator segment arranged around a rotor segment.

FIG. 11 is a cross-sectional diagram of the stator segment 630 arranged around the rotor segment 120. The rotor segment 120 is part of a rotor assembly 520, which is shown by the rotor segment 120 being positioned around the inner drum 110 (shown as dotted line for simplicity). Likewise, the stator segment 630 is part of a stator assembly 840, which is shown by the stator segment 630 being position inside of the outer drum 150 (also shown as a dotted line for simplicity). FIG. 11 shows that the inflow of the fluid (shown as arrows 428) to the upstream portion of the rotor fluid passageway 21 is directed into the stator fluid passageway 22 of the stator assembly 630, where it is turn around (as indicated by arrow 739) and directed back into the downstream portion of the rotor fluid passageway 21 (shown as arrows 429).

In operation, the fluid passes between the rotor segment 120 and the stator segment 630 across the apertures 121 in the rotor segment and the apertures 131 in the stator segment 630, where the apertures 121 of the rotor segment 120 are spinning (e.g., moving in a direction into or out of the page) with respect to the apertures 131 of the stator segment 630. This movement of the rotor apertures 121 with respect to the stator apertures 131 creates a cavitation zone 1168 where, as the fluid passes between the apertures 121, 131, localized regions of extremely low pressure form in the fluid, which momentarily causes cavitation bubbles to form in the fluid. The subsequent and violent collapse of the cavitation bubbles generates heat within the fluid from the mechanical energy of the spinning rotor segment 120. Through the act of hydrodynamic cavitation, and/or secondary acoustic cavitation, the fluid is heated/pressurized to a degree that depends on the dimension of the apertures 121, 131, the rotational speed of the rotor segment 120, and the size of the gap 1190 between the rotor segment 120 and the stator segment 630. The strength of the cavitation generated in the cavitation region 1168 also depends on the fluid properties, for example, viscosity, specific heat, and heat of vaporization. In some instances the size, position, and number of the apertures 131, 132 in the stator segment 630 correspond and match with the apertures 121, 122 of the rotor segment 120. In some instances, an effective size of the overall fluid passageway through the boiler 100 (e.g., an effective cross-sectional area of the rotor fluid passageway 21 and stator fluid passageway 22 between the inlet 12 and the outlet 13) is a function of the total size of the apertures 131, 132 in the stator segment 630 and the apertures 121, 122 of the rotor segment 120 because, together, either one or both of the upstream apertures 121, 131 and the downstream apertures 122, 132 in each boiler segment, when aligned, defines, in some instances, a minimum effective cross section of the overall fluid passageway though the boiler 100. As a result, the fluid flow capacity of the boiler 100 can be designed to be sufficient to allow large amounts of flow without excessive pressure drops and without increasing the size of the gap 1190. In some instances the apertures 121, 122, 131, 132 of each segment of the boiler 100 are identical. In other instances, the size and arrangement of the apertures 121, 122, 131, 132 may vary along the boiler. For example, the apertures 121, 122, 131, 132 may increase in size from the segment closest to the inlet 12 to the segment closest to the outlet 13 in order to adjust for the heating of the fluid. In some instances, the gap 1190 also varies between different stages of the boiler 100.

In an exemplary embodiment, the radial clearance between the exterior surface of the rotor segment 120 and the stator segment 630 (e.g., the gap 1190) is less than 0.05 inches, specifically, in some examples, as low as 0.002". Generally, one skilled in the art will appreciate that different clearances may be necessary depending on fluid viscosity and the presence of impurities (e.g., dissolved salts, dirt, or debris) in the fluid.

After passing through the first cavitation zone 1168, the fluid is directed 739 by the stator segment 630 to a second cavitation region 1169 between the second set of apertures 132 of the stator drum 130 and the second set of apertures of the rotor segment 120. In this manner, each rotor and stator segment 120, 630 combine two create two cavitation regions 1168, 1169 per 'stage' of the cavitation boiler 100, where a stage is defined as a combined rotor and stator segment 120, 130.

Figure 12:
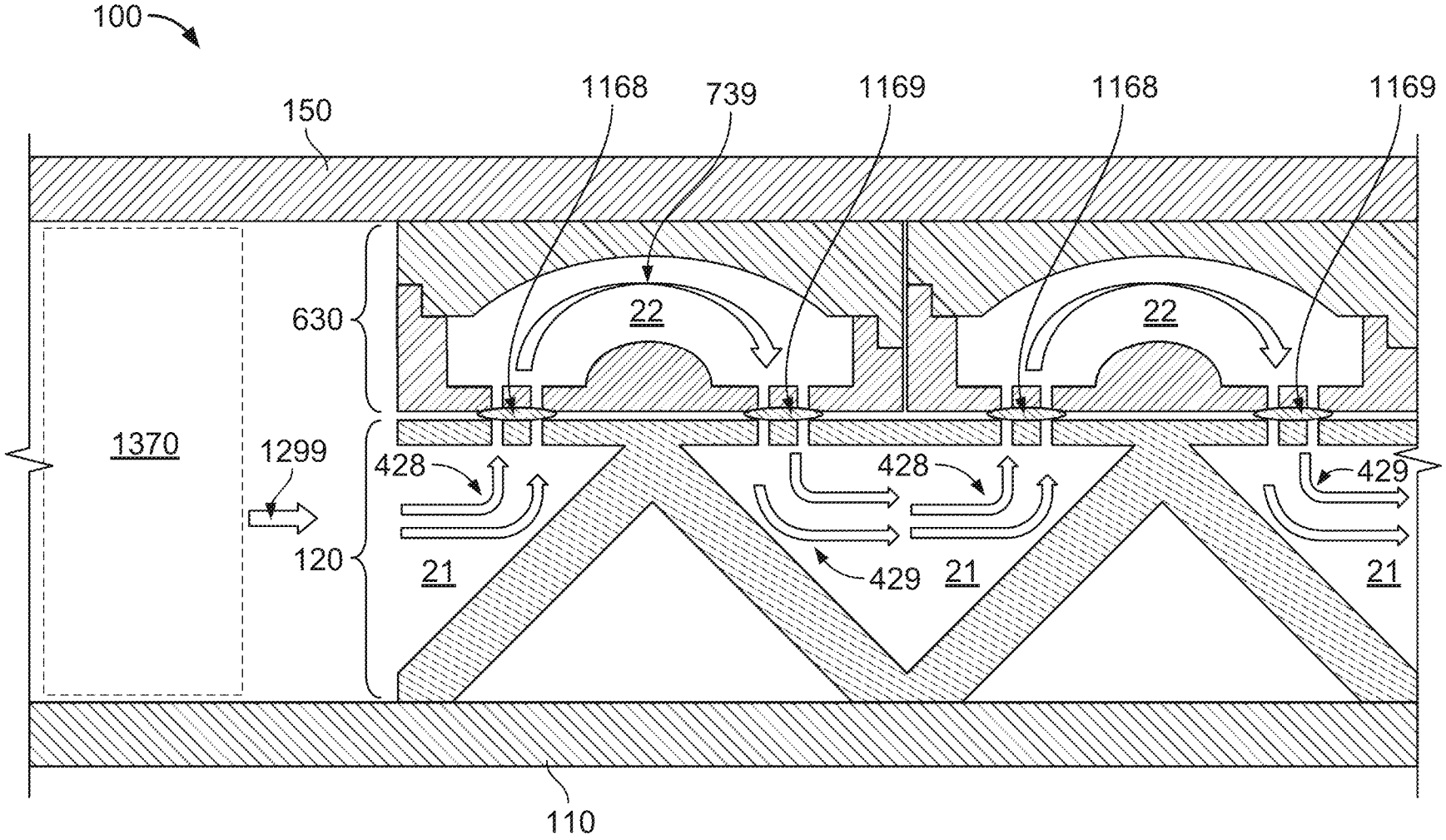
FIG. 12 is a cross-sectional diagram of a stator assembly arranged around a rotor assembly in a cavitation boiler.

FIG. 12 is a cross-sectional diagram of two adjacent stator assemblies 630 arranged around two adjacent rotor assemblies 120 in a cavitation boiler 100. FIG. 12 also shows a non-cavitation segment 1370 as an initial stage in the cavitation boiler 100. In some instances, this non-cavitation segment 1370 is not present or is not an initial stage, and fluid is directly supplied to the rotor fluid passageway 21 in the first rotor segment from the upstream housing 17. In other instances, the non-cavitation segment 1370 is a pumping stage configured to be power by rotation of the inner drum 100 and to drive the fluid through the downstream rotor and stator segments 120, 630. In some instances, the cavitation boiler 100 includes multiple pumping or non-cavitation stages 1370, which may be the first segment. In other instances, the non-cavitation segment 1370 is a collimator configured to create a uniform annular flow of fluid (as indicated by arrow 1299) into the first rotor segment 120 or other passive flow-control device or filter. In some instances, the non-cavitation segment 1370 is a standard pump impeller sized to provide the proper flow and pressure at a given rpm. In the configuration shown in FIG. 12, a first rotor segment 120 receives a flow 1299 of fluid into the rotor fluid passageway 21 where it is directed 428 into the stationary stator segment 630 across a first cavitation region 1168, then directed to exit the stator segment 630 and back into rotor segment 120 across a second cavitation region 1169, where the fluid is then in the downstream portion of the rotor fluid passageway 21. Here, the fluid is directed 429 out the downstream portion of the first rotor segment 120 and into the adjacent rotor segment, where the process of passing across the two cavitation regions 1168, 1169 is repeated. Eventually, at a final rotor segment 120 of the cavitation boiler 120, the fluid is directed out 429 of the cavitation boiler 100 and into the downstream housing 14 to be delivered out through the outlet 13.

While FIGS. 1-12 have shown the cavitation boiler 100 and rotor and stator segments 120, 130 as having a cylindrical shape, alternatively, the reaction cavitation boiler 100, in some instances, includes rotor and stator segments 120, 130 of different sizes that, in some instances, are sized in response to the expected changes in fluid properties that results from the cavitation of the fluid.

While FIGS. 1-12 have shown the cavitation boiler 100 integrated into the chassis 90 of an existing multi-stage pump, in other stances the cavitation boiler 100 is coupled to a generic input shaft driven by a generic motor and the fluid is supplied to an upstream end of the cavitation boiler 100 in any numbers of ways that one skilled in the art would appreciate. Similarly, in some instances, the downstream end of the cavitation boiler 100 may be coupled to any suitable housing or piping configured to receive the heated fluid of fluid, which may be under extreme pressure.

While FIGS. 1-12 show the input shaft 15 as being contiguous through the cavitation boiler 100, in some instances the input shaft 15 is a split shaft having two segments each configured to be attached to a respective end cap 160 such that no input shaft passes through the inner drum 100. In some instances, only one end cap 160 is 'powered,' such that the opposite end cap is freely spinning to enable a single motor to drive the rotor assembly 630.

While FIGS. 1-12 show the cavitation boiler 100 as a cavitation boiler, in some instances the cavitation boiler 100 is also fluid pumping device, configured to draw in fluid and supply the fluid under pressure at the downstream end. In some instances, this is enabled by having a separate fluid pumping segment in the cavitation boiler 100, and in other instances the rotor segment 120 includes features (e.g., vanes, fines, or impellors) configured to apply a pressure to the fluid in order to advance the fluid through the cavitation boiler 100.

While FIGS. 1-12 show the inner drum 110 and the outer drum 150 as constructed from a singular cylinder segment, in some instances, the inner drum 110 and the outer drum 150 are segmented as well, where each segment is mated together to form the inner drum 110 and the outer drum 150. In this manner, the inner drum 110 and the outer drum 150 can be modular to enable rotor and stator segments 120, 630 to be added and subtracted from the cavitation boiler 100.

While FIGS. 1-12 shown the adjacent rotor segments 120 and the stator segments 630 as abutting each other without linking or mating, one skilled in the art will appreciate that both the rotor segments 120 and the stator segments 630 may include mating features configured to restrain the movement of each rotor segment 120 and the stator segment 630 with respect to each other and with respect to the inner drum 110 or the outer drum 150. In some instances, the inner drum 110 or the outer drum 150 includes grooves or rails configured to align the attached rotor or stator segments 120, 630. In some instances, the upstream and downstream faces of one or both of the rotor segments 120 and the stator segments 630 include interlocking features configures to rotationally align adjacent segments.

Figure 13:
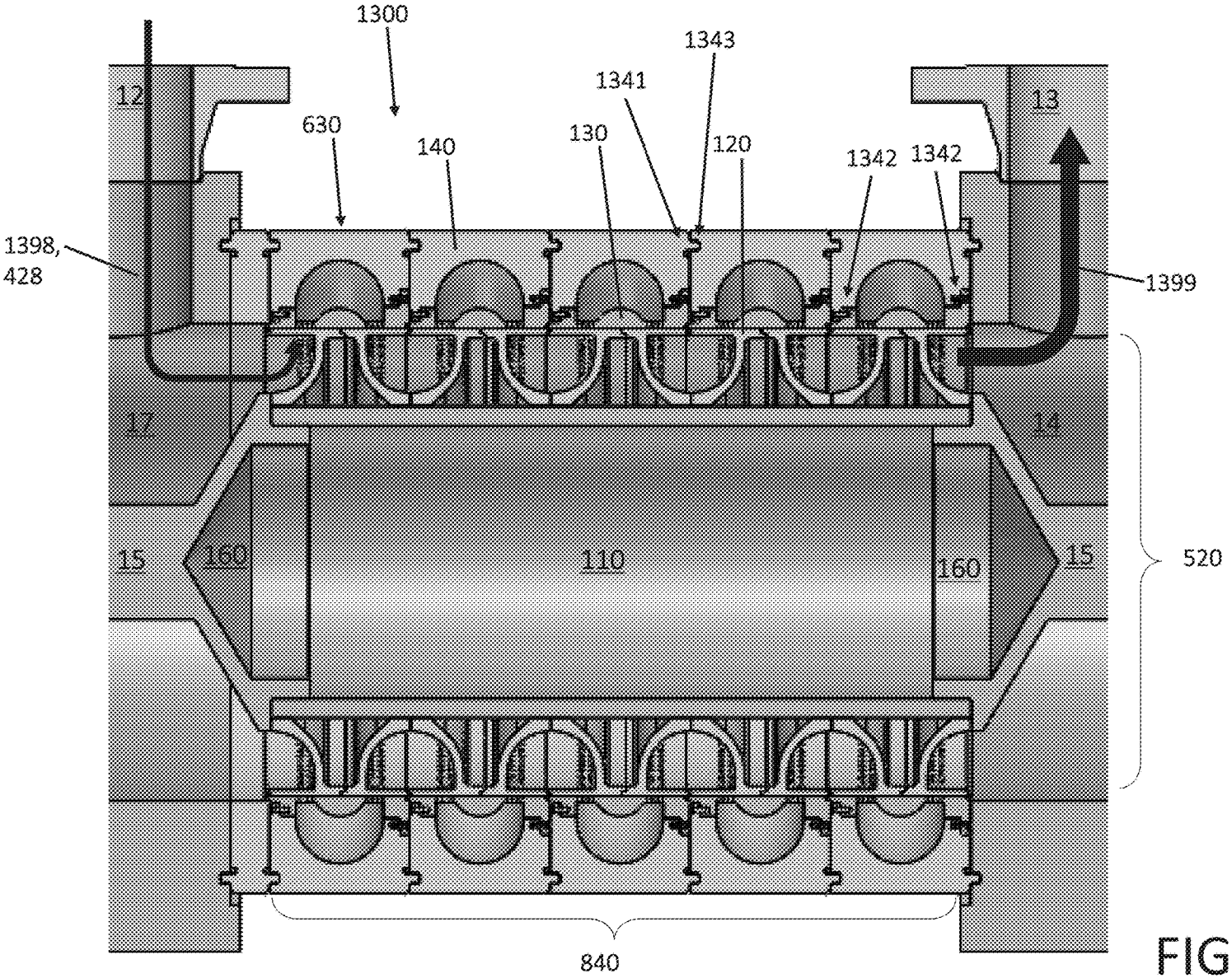
FIG. 13 is a cross-section of an example cavitation boiler without an outer drum.

FIG. 13 is a cross-sections of an example cavitation boiler without an outer drum. FIG. 13 shows a cavitation boiler 1300 including a stator assembly 840 and a rotor assembly 520. The stator assembly 840 is made up of axially stacked stator segments 630, each constructed from a stator casing 140 and a stator drum 130. The rotor assembly 520 includes axially stacked rotor segments 120 disposed on an inner drum 110. In this example, the inner drum 110 is attached on opposite sides to end caps 160, which are integrally formed with input shafts 15 extending outside the cavitation boiler 1300. The stator assembly 840 is sandwiched between an upstream housing 17 having an input 12 and a downstream housing 14 having an outlet 13. The upstream and downstream housings 17, 14 are open at the axial ends to permit the rotor assembly 520 to be installed axially into the cavitation boiler 1300 without requiring disassembly of the stator assembly 840. This is a more simple assembly step than shown in FIGS. 10A-10E, and is due to the open axial ends of the upstream and downstream housings 17, 14, which are subsequently sealed as shown in FIG. 14B. In operation, and as discussed in detail above, a flow of fluid (shown as arrow 1398) enters the upstream housing 17 via the inlet 12 and is directed by the endcap 160 to an upstream face of the first rotor segment 120 of the rotor assembly 520. After the fluid passes sequentially through each rotor and stator segment, it exists the final rotor segment, enters the downstream housing 14 and exits via outlet 13 (shown as arrow 1399).

Continuing to refer to FIG. 13, the stator assembly 840 does not include an outer drum around the stator segments. As a result, the stator casings 140 include annular interface elements 1341 to seal the cavitation boiler 1300. In some instances, a gasket or seal is in the interface elements 1341 between each stator casing 140. In addition, because the stator casings 140 are secured to the stator drums 130 by fasteners 1342, such that the stator segments form a plurality of separate subassemblies that are held together between the upstream and downstream housings 17, 14, as shown in FIG. 14A.

FIG. 13 shows the fasteners 1342 between each stator casing 140 and stator drum 130, where fasteners 1342 are placed annularly around the stator segment 630 on both the upstream and downstream sides. In addition, the interface elements 1341 are shown as an annular flange extending axially from a downstream side of the stator casing 140 and interfacing with an annular groove 1343 in the upstream side of an adjacent stator casing 140. In some instances, a gasket seal is disposed between the interface element 1341 and the annular groove 1343 to further seal the inside of the cavitation boiler 1300. In operation, and as discussed in more detail above, a flow of fluid (shown as arrow 1398) enters the upstream housing 17 via the inlet 12 and is directed by the endcap 160 to an upstream face of the first rotor segment 120 of the rotor assembly 520 and subsequently to the apertures in the rotor drum of the rotor segment 120 (e.g., the inflow of fluid 428 of FIG. 4).

Figure 14A:
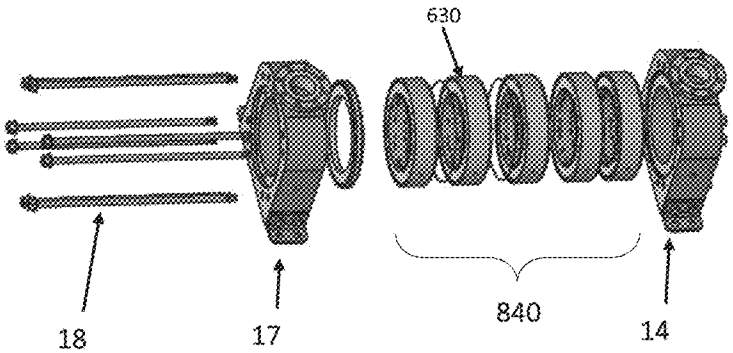
FIGS. 14A and 14B are an exploded view of the example cavitation boiler of FIG. 13, showing the stator assembly and of the rotor assembly into the cavitation boiler housing.
Figure 14B:
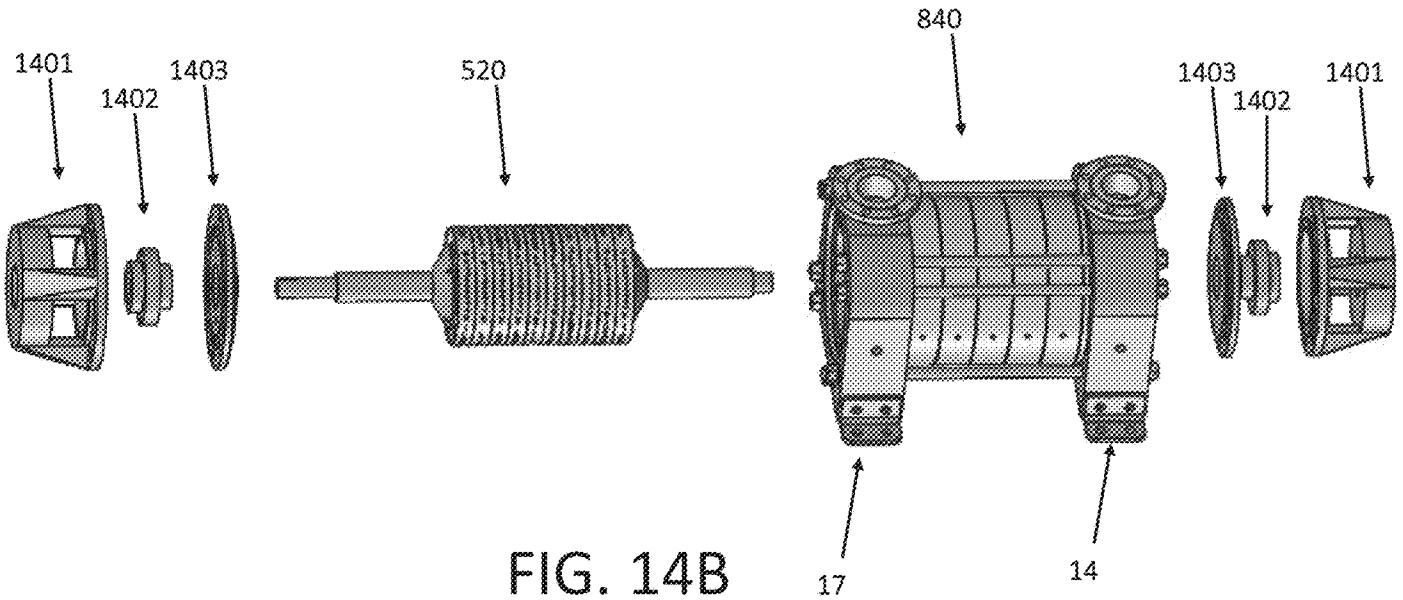

FIGS. 14A and 14B are exploded view of the example cavitation boiler of FIG. 13, showing the assembly of the stator assembly and rotor assembly into the cavitation boiler 1300. FIG. 14A shows a plurality of stator segments 630 axially stacked between an upstream housing 17 and a downstream housing 14 prior to assembly. In operation, the stator segments 630 are pressed together and the tension rods 18 secure the assembled stator assembly 840 between the upstream housing 17 and a downstream housing 14. Next, as shown in FIG. 14B, a completed rotor assembly 520, which here includes the inner drum 110 and the input shafts 150, is inserted into the stator assembly 840. Afterwards, end plates 1403 seal the open ends of the upstream housing 17 and a downstream housing 14 to form the boiler chamber, and bearing housings 1401 secure the end plates 1403 to the upstream housing 17 and a downstream housing 14 and secure a bearing 1402 to the input shaft 15. One advantage of the cavitation boiler 1300 having open axial ends is the ability to assemble a completed rotor assembly 520, with the inner drum 110, end caps 160, and input shafts 15 together before final assembly. As discussed previously, control of the tolerances between the rotor segments 120 and stator segments 630 is an important advantage of the overall design, and assembly of a completed rotor assembly 520 enables precise control of the overall runout across the drum surface 323*a,b* of the rotor assembly 520. In some instances, the runout, or the variability of concentricity over the axial length of the drum surface 323*a,b* of the rotor segments 120, is less than 0.0001". This ensures that the tolerances described above (e.g., as low as a 0.002 gap in the cavitation region between each of the combined rotor and segments) is maintained across the entire cavitation boiler 1300. This precise runout and pre-assembly also enables the rotor assembly 520 to be precisely balanced prior to installation. For example, the rotor assembly 520, after pre-assembly, can be machined, polished, and balanced as a unit prior to final assembly to form the cavitation boiler 1300. In addition, the rotor assembly 520 can be easily removed and serviced after operation to check and correct the tolerances and, if necessary, replace a damaged or out of tolerance rotor segment.

A number of implementations have been described. Nevertheless, it will be understood that various modifications may be made. Accordingly, other implementations are within the scope of the following claims.

What is claimed is:

1. A cavitation boiler segment configured to be disposed in a housing, the cavitation boiler segment comprising:

a rotor segment configured to be secured around an inner drum of the housing, the rotor segment comprising:

a rotor drum having first and second annular banks of apertures through the rotor drum, the rotor drum defining an outer surface of the rotor segment, and the first and second annular banks of apertures disposed on the outer surface of the rotor segment, a hub configured to interface with the inner drum, and an annular web connecting the hub to the rotor drum between the first and second annular banks of apertures, the annular web comprising:

an upstream surface defining a first fluid passageway between an upstream face of the rotor segment and the first bank of apertures, and a downstream surface defining a third fluid passageway between a downstream face of the rotor segment and the second bank of apertures; and a stator segment configured to be disposed around the rotor segment, the stator segment comprising:

a stator drum having third and fourth annular banks of apertures through the stator drum arranged to overlap the first and second banks of apertures through the rotor drum, the stator drum defining an inner surface of the stator segment, and the third and fourth annular banks of apertures disposed on the inner surface of the stator segment, and a stator casing configured enclose the third and fourth annular banks of apertures in an interior chamber defining a second fluid passageway between the third and fourth annular banks of apertures; and wherein the first, second, and third fluid passageways together define a flowpath through the cavitation boiler segment, the flowpath configured to direct an axial flow of fluid starting at the first fluid passageway, then through the second fluid passageway, and then through the third fluid passageway.

2. The cavitation boiler segment of claim 1, wherein the outer surface of the rotor segment and the inner surface of the stator segment define a cavitation region therebetween.

3. The cavitation boiler segment of claim 2, wherein the cavitation region comprises a first cavitation region between the first and third banks of apertures, and a second cavitation region between the second and fourth banks of apertures, and wherein, when the rotor segment rotates with respect to the stator segment, the first cavitation region is configured to generate cavitation in the fluid flowing radially outward from to the first bank of apertures to the third bank of apertures, and the second cavitation region is configured to generate cavitation in the fluid flowing radially inward from the fourth bank of apertures to the second bank of apertures.

4. The cavitation boiler segment of claim 1, wherein, the rotor drum extends from the web to an upstream drum lip defining an upstream segment of the rotor drum, and from the web to a downstream drum lip defining a downstream segment of the rotor drum, the upstream segment of the rotor drum having the first bank of apertures and the downstream segment of the rotor drum having the second bank of apertures.

5. The cavitation boiler segment of claim 4, wherein the rotor segment comprises:

a first ring having:

the upstream segment of the rotor drum, a first annular web comprising the upstream surface of the annular web, and an upstream segment of the hub; and a second ring having:

the downstream segment of the rotor drum, a second annular web comprising the downstream surface of the annular web, and a downstream segment of the hub, wherein the first and second rings are configured to be arranged adjacent to each other on the inner drum of the housing and, when adjacent, form the outer surface of the rotor segment.

6. The cavitation boiler segment of claim 5, wherein the first and second rings are integrally formed with the rotor segment.

7. The cavitation boiler segment of claim 5, wherein:

the first ring comprises the first fluid passageway and the first ring is configured to receive the axial flow of the fluid and direct the fluid in a radially outward direction across the annular bank of apertures, and the second ring comprises the third fluid passageway and the second ring is configured to receive a radially inward flow of the fluid from the second annular bank of apertures and direct the fluid in the axial direction.

8. The cavitation boiler segment of claim 7, wherein the first ring comprises:

the upstream surface of the first ring is shaped to direct the axial fluid flow received by the first fluid passageway in a radially outward direction through the first bank of apertures; and the downstream surface of the second ring is shaped to direct the radially inward fluid flow received from the second bank of apertures in the axial direction.

9. The cavitation boiler segment of claim 7, wherein the upstream face of the first ring defines an inlet opening, and the downstream face of the second ring defines and outlet opening, and wherein the inlet and outlet opening define opposing halves of an annular chamber.

10. The cavitation boiler segment of claim 9, wherein the downstream and upstream faces of the rotor segment are each configured to interface with a corresponding face of a second rotor segment arranged adjacent to the rotor segment.

11. The cavitation boiler segment of claim 9, wherein the first and second fluid passageways are annular channels around the rotor segment.

12. The cavitation boiler segment of claim 1, wherein the first and second annular banks of apertures are arranged in parallel around the outer surface of the rotor segment, and the third and fourth annular banks of apertures are arranged in parallel around the stator drum of the stator segment.

13. The cavitation boiler segment of claim 1, wherein the stator casing comprises:

an outer surface configured to secure the stator segment to an outer drum of the housing, and an inner surface having formed therein an annular channel defining at least a portion of the interior chamber of the stator segment.

14. The cavitation boiler segment of claim 1, wherein a gap between the outer surface of the rotor segment and the inner surface of the stator ring is spaced between 0.05 and 0.002 inches along the entire axial length.

15. The cavitation boiler segment of claim 1, wherein, when the stator segment is arranged around the rotor segment, the first and third fluid passageways of the rotor segment are only in fluid connection with each other through the second fluid passageway of the stator segment, other than a gap between the outer surface of the rotor drum and the inner surface of the stator drum.

16. The cavitation boiler segment of claim 15, wherein the gap is between 0.05 and 0.002 inches along the entire axial length.

17. The cavitation boiler segment of claim 1, wherein the third fluid passageway of the stator is configured to direct a radially outward flow from the third bank of apertures into a radially inward flow toward the fourth bank of apertures.

18. A cavitation boiler chamber comprising:

a housing comprising a rotatable inner drum including first and second end caps configured to couple the inner drum to an input shaft; and a plurality of cavitation boiler segments according to claim 1 disposed in the housing, the plurality of cavitation boiler segments being arranged in series such that a fluid passageway is defined through the plurality of cavitation boiler segments, wherein the flowpath through each cavitation boiler segment defines a sequential portion of the fluid passageway, and wherein each rotor assembly is arranged in the housing and secured to the rotatable inner drum, and each stator assembly is arranged in the housing and secured to a stationary outer drum of the housing.

19. The cavitation boiler chamber of claim 18, comprising a pump segment disposed in the housing upstream of the plurality of cavitation boiler segments, the pump segment having an outlet in fluid communication with the upstream face of a first rotor segment of the plurality of cavitation boiler segments, the pump segment being configured to pump the fluid through the fluid passageway of the plurality of cavitation boiler segments.

20. A cavitation device, the cavitation device comprising:

a cavitation boiler chamber according to claim 18;

an inlet housing defining a fluid inlet into the boiler chamber housing, the fluid inlet in fluid communication with the fluid passageway of the cavitation boiler chamber;

an outlet housing defining a fluid outlet from the cavitation boiler chamber, the fluid outlet in fluid communication with the fluid passageway; and an input shaft spanning between the inlet housing and the outlet housing and coupled to the rotatable inner drum of the housing of the cavitation boiler, the input shaft configured to be coupled to a motor.

21. A cavitation boiler segment configured to be disposed in a housing, the cavitation boiler segment comprising:

a rotor segment configured to be secured around an inner drum of the housing, the rotor segment comprising:

a rotor drum defining an outer surface of the rotor segment and having a first and a second set of apertures through the outer surface of the rotor drum, and the rotor segment defining an upstream annular fluid passageway and a downstream annular fluid passageway adjacent and separate from the upstream annular fluid passageway, the upstream annular fluid passageway is configured to receive an axial flow of a fluid and direct the fluid in a radially outward direction across the first set of apertures of the rotor drum, and the downstream annular fluid passageway is configured to receive a radially inward flow of the fluid from the second set of apertures and direct the fluid in an axial direction, wherein the rotor segment is configured to interface with a second rotor segment disposed adjacent to the rotor segment, such that the downstream annular fluid passageway of the rotor segment is in fluid communication with the upstream annular fluid passageway of the second rotor segment; and a stator segment configured to be disposed around the rotor segment, the stator segment comprising:

a stator drum defining an inner surface of the stator segment and having a third and a fourth set of apertures through the stator drum located to overlap the first and second sets of apertures when the stator segment is disposed around the rotor segment, and a stator casing enclosing the third and fourth sets of apertures in an interior chamber defining a stator fluid passageway between the third and fourth sets of apertures.

22. A method for generating cavitation with a cavitation boiler segment comprising a rotor segment disposed inside a stator segment, the method comprising:

rotating the rotor segment inside the stator segment such that a first plurality of apertures of the rotor segment transits a first plurality of apertures of the stator segment and a second plurality of apertures of the rotor segment transits a second plurality of apertures of the stator segment, the first plurality of apertures of the rotor segment and the second plurality of apertures of the rotor segment are disposed on an outer surface of the rotor segment, wherein the first plurality of apertures of the rotor and stator segments define a first cavitation region therebetween, and the second pluralities of apertures of the rotor and stator segments define a second cavitation region therebetween;

accepting a flow of a fluid at an upstream side of the rotor segment;

passing the fluid from the an upstream side of the rotor segment into a fluid passageway in the stator segment through the first cavitation region, the rotating of the rotor segment generating cavitation in the fluid passing through the first cavitation region; and passing the fluid from the fluid passageway in the stator segment into a downstream side of the rotor segment through the second cavitation region, the rotating of the rotor segment generating cavitation in the fluid passing through the second cavitation region.

* * * * *